US009520215B2

(12) United States Patent
Yoneda

(10) Patent No.: US 9,520,215 B2
(45) Date of Patent: Dec. 13, 2016

(54) CHIP RESISTOR AND METHOD OF MANUFACTURING THE SAME

(71) Applicant: ROHM CO., LTD., Kyoto-shi, Kyoto (JP)

(72) Inventor: Masaki Yoneda, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 953 days.

(21) Appl. No.: 13/718,415

(22) Filed: Dec. 18, 2012

(65) Prior Publication Data

US 2013/0104389 A1 May 2, 2013

Related U.S. Application Data

(62) Division of application No. 12/839,888, filed on Jul. 20, 2010, now Pat. No. 8,354,912.

(30) Foreign Application Priority Data

Jul. 27, 2009 (JP) ..... 2009-173782

(51) Int. Cl.

| | |
|---|---|
| ***H01C 1/148*** | (2006.01) |
| ***H01C 7/00*** | (2006.01) |
| ***H01C 17/28*** | (2006.01) |
| ***H01C 17/00*** | (2006.01) |

(52) U.S. Cl.

CPC ..... *H01C 17/006* (2013.01); *H01C 1/148* (2013.01); *H01C 7/003* (2013.01); *H01C 17/28* (2013.01); *H01C 17/281* (2013.01); *H01C 17/288* (2013.01); *Y10T 29/49082* (2015.01); *Y10T 29/49101* (2015.01)

(58) Field of Classification Search

CPC ..... H01C 17/006; H01C 17/28; H01C 17/281; H01C 17/288; H01C 1/148; H01C 7/003; Y10T 29/49082; Y10T 29/49099; Y10T 29/49101

See application file for complete search history.

(56) References Cited

U.S. PATENT DOCUMENTS

| | | | | |
|---|---|---|---|---|
| 5,495,223 | A | 2/1996 | Honda et al. | |
| 5,844,468 | A | 12/1998 | Doi et al. | |
| 6,023,217 | A * | 2/2000 | Yamada | H01C 1/142 338/307 |
| 6,204,749 | B1 | 3/2001 | Ishihara | |
| 6,577,225 | B1 | 6/2003 | Poole | |

(Continued)

FOREIGN PATENT DOCUMENTS

| | | |
|---|---|---|
| CN | 1655289 | 8/2005 |
| JP | 11-40401 | 12/1999 |

(Continued)

*Primary Examiner* — Livius R Cazan

(74) *Attorney, Agent, or Firm* — Hamre, Schumann, Mueller & Larson, P.C.

(57) ABSTRACT

A method of manufacturing a chip resistor includes the following steps. A resistor layer is formed on an obverse surface of a material substrate. A plurality of substrate sections are defined in the material substrate by forming, in the obverse surface of the material substrate, a plurality of first grooves each of which is elongated in a first direction. A conductor layer is formed in each of the first grooves. The substrate sections are cut along lines extending in a second direction different from the first direction.

19 Claims, 25 Drawing Sheets

(56) References Cited

U.S. PATENT DOCUMENTS

| | | | | |
|---|---|---|---|---|
| 6,636,143 | B1 * | 10/2003 | Hashimoto | H01C 1/142 219/619 |
| 7,109,841 | B2 | 9/2006 | Haga et al. | |
| 7,728,710 | B2 | 6/2010 | Mizuno et al. | |
| 2004/0027234 | A1 * | 2/2004 | Hashimoto et al. | H01C 1/142 338/309 |
| 2005/0204547 | A1 | 9/2005 | Osaki et al. | |
| 2006/0040094 | A1 | 2/2006 | Mizuno et al. | |
| 2009/0102042 | A1 * | 4/2009 | Uoya | H01L 21/6835 257/690 |
| 2011/0018677 | A1 | 1/2011 | Yoneda | |

FOREIGN PATENT DOCUMENTS

| | | | | |
|---|---|---|---|---|
| JP | 2008-153408 | | 7/2008 | |
| JP | 2008-235670 | | 10/2008 | |
| WO | WO 2005081271 | A1 * | 9/2005 | H01C 17/006 |

* cited by examiner

CHIP RESISTOR AND METHOD OF MANUFACTURING THE SAME

This application is a divisional of U.S. application Ser. No. 12/839,888, filed Jul. 20, 2010, now U.S. Pat. No. 8,354,912, which application is incorporated herein by reference.

BACKGROUND OF THE INVENTION

1. Field of the Invention

The present invention relates to a chip resistor and a method of manufacturing a chip resistor.

2. Description of the Related Art

FIGS. 45A-46B illustrate a chip resistor manufacturing method as related art for better understanding of the present invention. FIG. 45A is a plan view illustrating a step of the manufacturing method, whereas FIG. 45B is a sectional view taken along lines 9α-9α in FIG. 45A.

In the illustrated method, an insulating substrate 91 is first prepared as seen from FIGS. 45A and 45B. Then, a surface electrode layer 94 made up of a plurality of rectangular portions is formed on the obverse surface 91*a* of the insulating substrate 91. Then, a resistor layer 92 made up of a plurality of rectangular portions is formed on the obverse surface 91*a* of the insulating substrate 91 to partially overlap the surface electrode layer 94. Then, a reverse surface electrode layer 94' made up of a plurality of rectangular portions is formed on the reverse surface 91*b* of the insulating substrate 91, similarly to the surface electrode layer 94. Then, the insulating substrate 91 is bonded to a sheet member 961 via an adhesive layer 963.

As illustrated in FIG. 46A, the insulating substrate 91 bonded to the sheet member 961 is cut along lines Dx (see also FIG. 45A) to obtain a plurality of bar members 911 each in the form of a strip. As illustrated in FIG. 46B, the bar members 911 are then removed from the sheet member 961. Then, as illustrated in FIG. 46C, the bar members 911 are rearranged so that their side surfaces face upward. As indicated by the arrows in FIG. 46D, electrode layers 93 are collectively formed on the side surfaces of the bar members 911. Then, the bar members 911 are again bonded to a sheet member like the one illustrated in FIG. 45B. The bar members 911 are then cut in a direction perpendicular to the length of the bar members 911 into an appropriate size and then removed from the sheet member. Thus, chip resistors are obtained.

In recent years, chip resistors have been reduced in size. With the size reduction of chip resistors, the above-described bar members 911 need to become thin. To rearrange such thin bar members 911 into a proper position (see FIG. 46C) after the removal from the sheet member 961 requires a highly precise technique. If the rearrangement is not precise, electrode layers 93 cannot be formed precisely on the side surfaces of the bar members 911, which hinders yield enhancement.

SUMMARY OF THE INVENTION

The present invention has been proposed under the circumstances described above. It is therefore an object of the present invention to provide a chip resistor manufacturing method whereby even small chip resistors can be produced precisely.

According to a first aspect of the present invention, there is provided a method of manufacturing a chip resistor. The method comprises the steps of: forming a resistor layer on an obverse surface of a material substrate; defining a plurality of substrate sections in the material substrate by forming, in the obverse surface of the material substrate, a plurality of first grooves each being elongated in a first direction; forming a conductor layer in each of the first grooves; and cutting the substrate sections in a second direction different from the first direction.

In the above method, a conductor layer is formed in each first groove, thereby covering at least the side surfaces of the groove. Thus, it is not necessary to separate the substrate sections and rearrange them, as shown in FIG. 46C, for formation of a conductor layer. As a result, the respective substrate sections maintain the proper positional relationship during the processes of forming the grooves and forming the conductor layer, and the chip resistors can be manufactured precisely.

Preferably, each of the grooves includes a bottom surface.

Preferably, the method further comprises the step of forming, in the bottom surface of each first groove, a second groove smaller in width than said each first groove. With this arrangement, it is possible to prevent a dicing blade, for example, from coming into contact with the conductor layer in making the second groove with the dicing blade. Thus, the conductor layer is not unduly chipped off in the separation process of the material substrate.

Preferably, the resistor layer includes forming a plurality of resistor rows spaced from each other in the second direction, where each of the resistor rows includes a plurality of resistor strips arranged in the first direction, and each of the resistor strips elongated in the second direction. In the step of defining a plurality of substrate sections, each of the first grooves is formed between adjacent two of the resistor rows.

Preferably, the method further comprises the step of forming a surface electrode layer on the obverse surface of the material substrate before the step of forming a resistor layer, wherein the surface electrode layer includes a plurality of surface electrode rows spaced from each other in the second direction, and each of the surface electrode rows includes a plurality of surface electrode portions arranged in the first direction. In the step of forming a resistor layer, each of the resistor strips is formed in a manner such that it overlaps two surface electrode portions that are adjacent to each other in the second direction.

Preferably, the conductor layer includes a plurality of conductive portions each of which is electrically connected to one of the resistor strips.

Preferably, the step of forming a conductor layer includes printing a conductive material.

Preferably, the step of forming a conductor layer includes sputtering of a conductive material.

Preferably, the method further comprises the step of forming, before the forming of the conductor layer, a masking layer that covers the resistor layer and is provided with openings for exposing the first grooves.

According to a second aspect of the present invention, there is provided a chip resistor comprising: a substrate including an obverse surface, a reverse surface opposite to the obverse surface, and a side surface connected to the obverse surface and the reverse surface; a resistor layer formed on the obverse surface; and a conductor layer formed on the side surface and electrically connected to the resistor layer. The substrate is provided with a projection located at the side surface and between the conductor layer and the reverse surface of the substrate.

Preferably, the conductor layer extends from the side surface onto the obverse surface of the substrate.

Preferably, the chip resistor further comprises a surface electrode layer formed on the obverse surface of the substrate and held in contact with the resistor layer, where the surface electrode layer is arranged to intervene between the conductor layer and the obverse surface of the substrate.

Preferably, the resistor layer includes a plurality of resistor strips spaced from each other in a first direction, and the conductor layer includes a plurality of conductive portions each of which is electrically connected to one of the resistor strips.

Preferably, the conductive portions are spaced from each other in the first direction.

Preferably, the projection is in contact with the conductor layer.

Preferably, the chip resistor further includes a plate layer covering the conductor layer and part of the projection.

Other features and advantages of the present invention will become more apparent from detailed description given below with reference to the accompanying drawings.

DETAILED DESCRIPTION OF THE PREFERRED EMBODIMENTS

Preferred embodiments of the present invention are described below with reference to the accompanying drawings.

Figure 1:
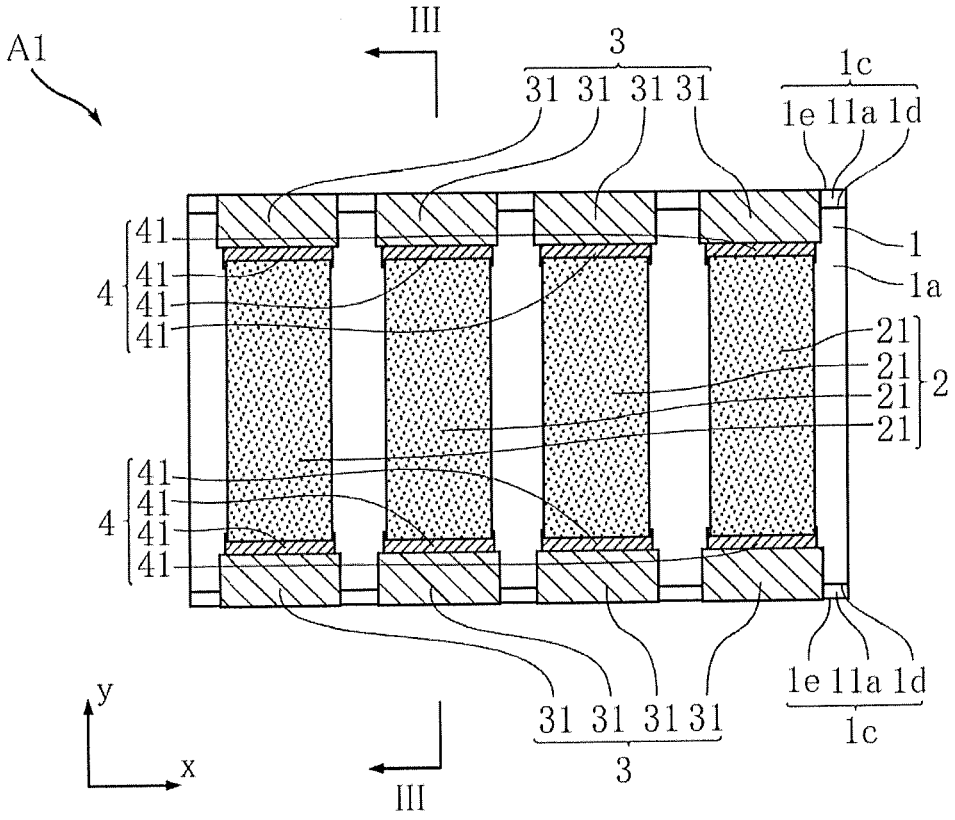
FIG. 1 is a plan view illustrating an example of chip resistor according to a first embodiment of the present invention.
Figure 2:
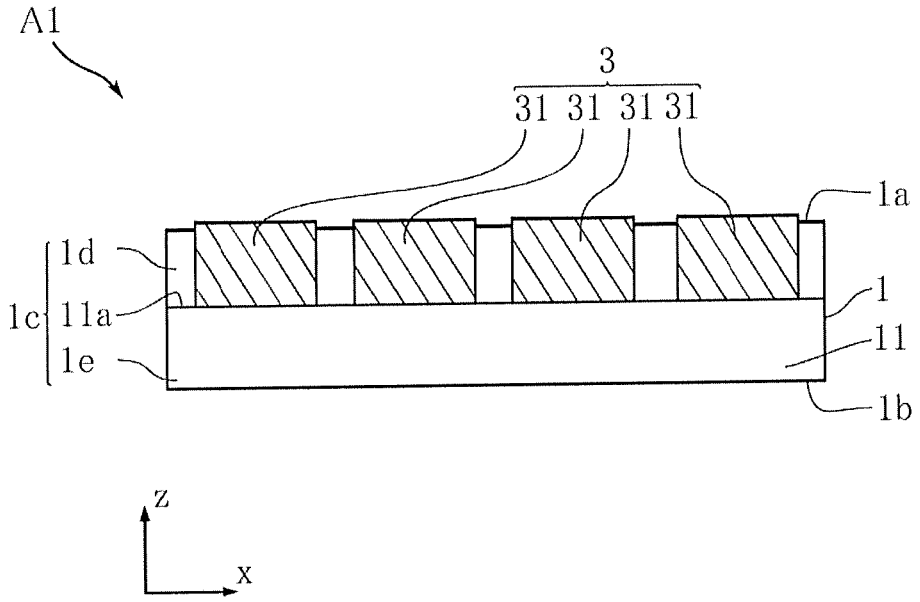
FIG. 2 is a side view of the chip resistor illustrated in FIG. 1.
Figure 3:
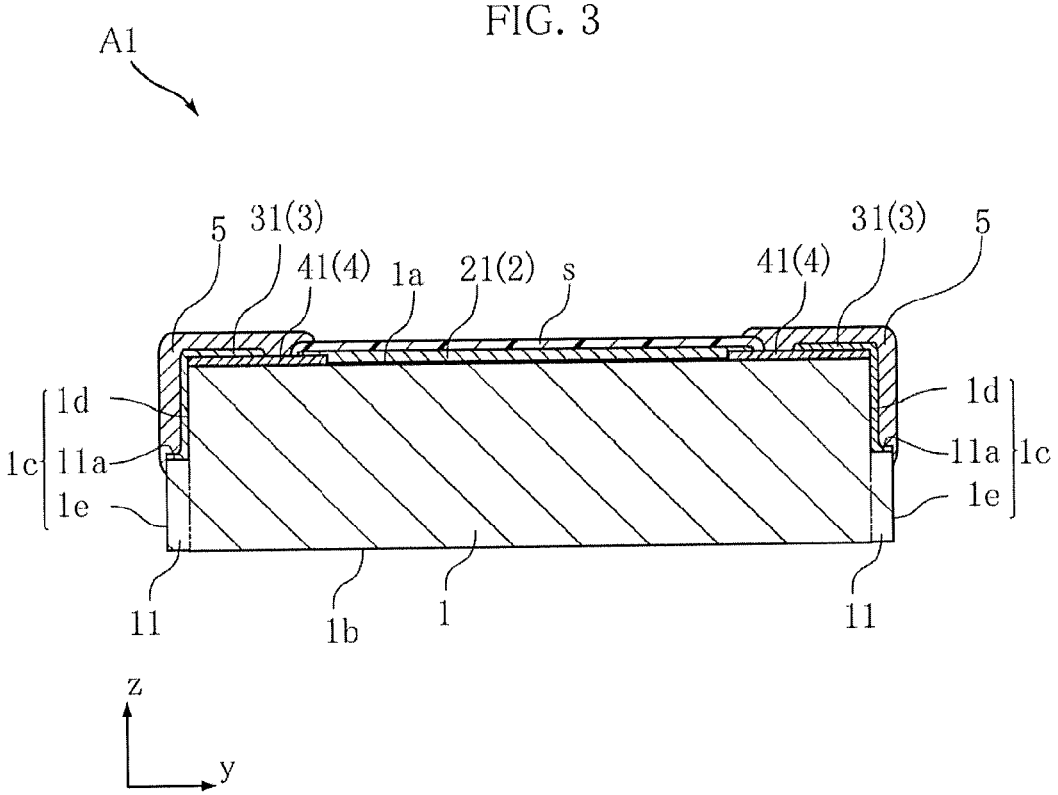
FIG. 3 is a sectional view taken along lines in FIG. 1.

FIG. 1 is a plan view illustrating an example of chip resistor according to a first embodiment of the present invention. FIG. 2 is a side view of the chip resistor illustrated in FIG. 1. FIG. 3 is a sectional view taken along lines III-III in FIG. 1.

The chip resistor A1 illustrated in these figures includes a substrate 1, a resistor layer 2, a protective layer s, a pair of conductor layers 3, a pair of surface electrode layers 4 and a pair of plate layers 5. For easier understanding, the illustration of the protective layer s and the plate layers 5 are omitted in FIGS. 1 and 2.

The substrate 1 is rectangular as viewed in x-y plan and made of an insulating material such as alumina. The size of the substrate 1 in the direction x is e.g. 900 μm. The size of the substrate 1 in the direction y is e.g. 400 μm. The thickness of the substrate 1 (i.e., the size in the direction z) is e.g. 100 μm. As clearly illustrated in FIG. 3, the substrate 1 includes an obverse surface 1*a*, a reverse surface 1*b* and side surfaces 1*c*. The side surfaces 1*c* are connected to the obverse surface 1*a* and the reverse surface 1*b*. The substrate 1 is formed with a projection 11 on each side surface 1*c* at a position closer to the reverse surface 1*b*. The projections 11 project outward from the substrate 1 in the direction y. The size (thickness) of the projections 11 in the direction y is e.g. 15 μm. The size of the projections 11 in the direction z is e.g. 90 μm. Due to the provision of the projections 11, each side surface 1*c* is made up of surface portions 1*d*, 11*a* and 1*e*. The surface portions 1*d* and 1*e* extend along the z-x plane. The surface portion 11*a* extends along the x-y plane and is connected to the surface portions 1*d* and 1*e*. A non-illustrated protective layer is formed on the reverse surface 1*b* of the substrate 1.

As illustrated in FIGS. 1 and 3, the resistor layer 2 is formed on the obverse surface 1*a* of the substrate 1. The resistor layer 2 is made of a resistive material such as ruthenium oxide. As illustrated in FIG. 1, the resistor layer 2 includes a plurality of resistor strips 21. The resistor strips 21 extend in the direction y and are arranged side by side in the direction x. Although four resistor strips 21 are provided in this embodiment, the number of resistor strips 21 is not limited to four. The resistor strips 21 are in the form of a film having a thickness of e.g. 10 μm.

As illustrated in FIG. 3, the protective layer s covers the resistor layer 2 for protection. The protective layer s extends in the direction x with a uniform width. The protective layer s is made of e.g. an insulating resin.

As illustrated in FIGS. 1 and 3, the surface electrode layers 4 are formed on the obverse surface 1*a* of the substrate 1. The surface electrode layers 4 are made of a conductive material such as silver. As illustrated in FIG. 1, each of the surface electrode layers 4 is made up of a plurality of surface electrode portions 41. Specifically, as illustrated in FIGS. 1 and 3, four surface electrode portions 41 are provided at each of two edges of the substrate 1 which are spaced in the direction y, and the four electrode portions 41 on each edge are arranged side by side in the direction x correspondingly to the resistor strips 21. Each surface electrode portion 41 is covered with a corresponding resistor strip 21 at a portion closer to the center in the direction y, so that the surface electrode portion 41 is electrically connected to the resistor strip 21. The surface electrode portions 41 have a thickness of e.g. 10 μm.

As illustrated in FIGS. 1-3, each of the conductor layers 3 extends from a side surface 1*c* of the substrate 1 onto the obverse surface 1*a* of the substrate 1. The conductor layer 3 overlaps the surface electrode portions 41 and the obverse surface 1*a* of the substrate 1 as viewed in the direction z. The conductor layer 3 is made of a conductive metal such as nickel or chrome. As illustrated in FIGS. 1 and 2, the conductor layer 3 is made up of a plurality of conductive portions 31 spaced from each other in the direction x. The size of the conductive portions 31 in the direction x is different from that of the surface electrode portions 41, or larger than that of the surface electrode portions 41 in this embodiment as illustrated in FIG. 1. Unlike this, however, the size of the conductive portions 31 in the direction x may be equal to that of the surface electrode portions 41. As illustrated in FIG. 3, the conductive portions 31 are in contact with the surface portion 11*a* and do not cover the surface portion 1*e*. The conductive portions 31 have a thickness of e.g. 10 nm. The conductive portions 31 are in contact with the surface electrode portions 41, respectively. With this arrangement, each of the conductive portions 31 is electrically connected to a corresponding one of the resistor strips 21 by the surface electrode portion 41.

As illustrated in FIG. 3, each of the plate layers 5 covers the surface electrode layer 4, the conductor layer 3 and part of the projection 11. The plate layer 5 has a thickness of e.g. 10 μm. The plate layer 5 has a double-layer structure of nickel and tin.

Figure 4:
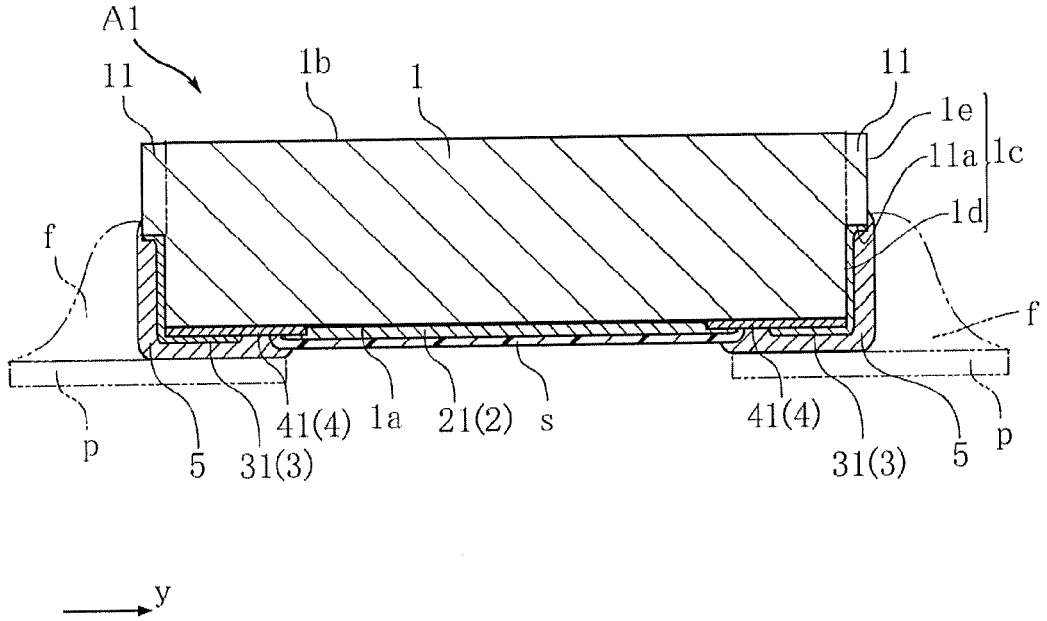
FIG. 4 illustrates the chip resistor of FIGS. 1-3 mounted on a wiring pattern.

FIG. 4 illustrates the chip resistor A1 mounted on a wiring pattern p. In FIG. 4, the obverse surface 1*a* of the substrate 1 is utilized as a mount surface of the chip resistor A1. The chip resistor A1 is mounted on the wiring pattern p by forming fillets f.

A method of manufacturing a chip resistor A1 is described below with reference to FIGS. 5-20.

Figure 5:
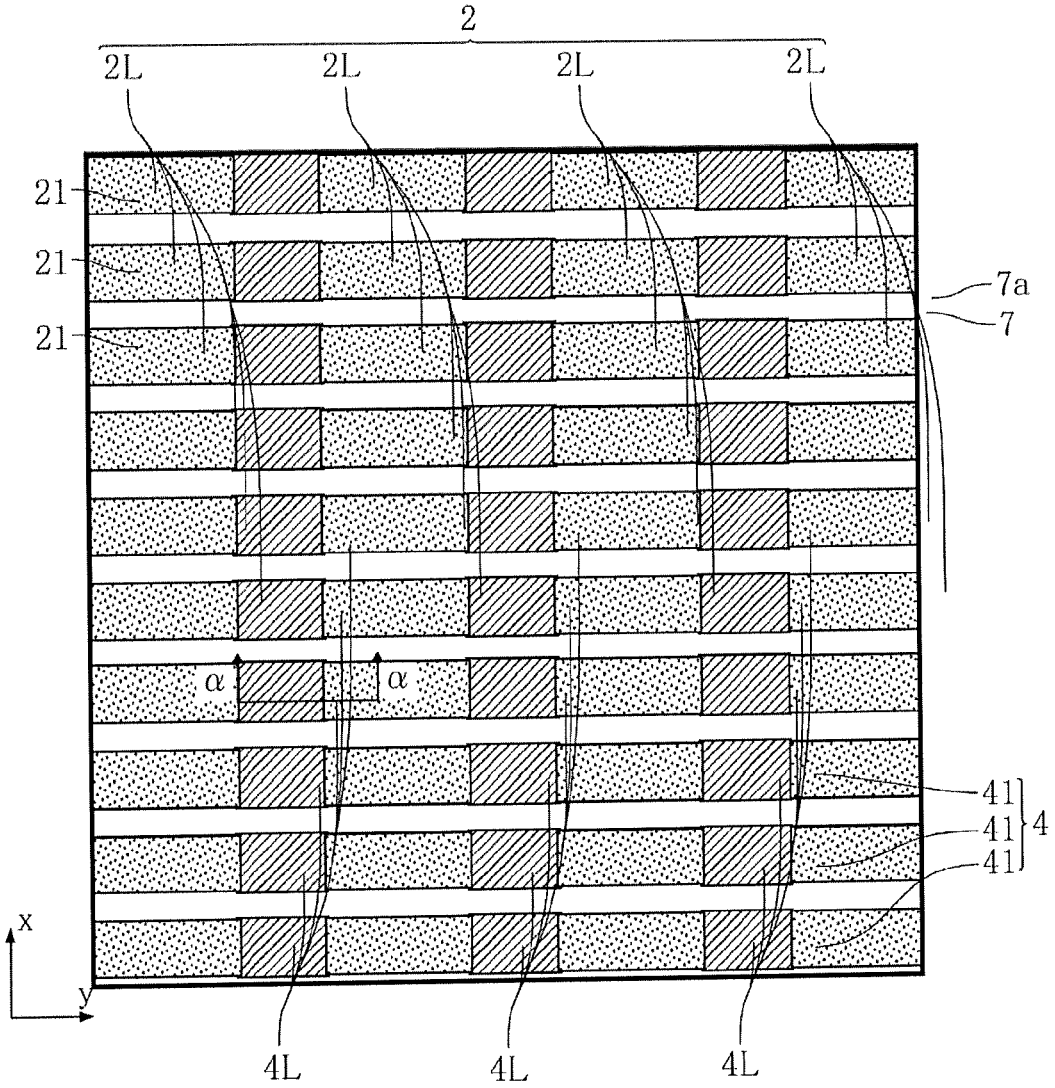
FIG. 5 is a plan view illustrating a step of a method of manufacturing the chip resistor of FIG. 1.
Figure 6:
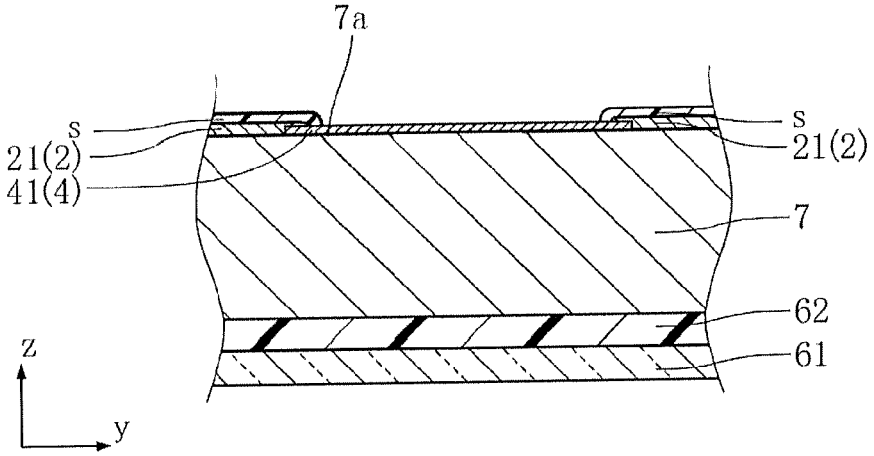
FIG. 6 is a sectional view taken along lines α-α in FIG. 5.

FIG. 5 is a plan view illustrating a step of a method of manufacturing a chip resistor A1. FIG. 6 is a sectional view taken along lines α-α in FIG. 5.

First, as illustrated in FIGS. 5 and 6, a material substrate 7 made of an insulating material such as alumina is prepared. Then, a surface electrode layer 4 is formed on an obverse surface 7*a* of the material substrate 7. Specifically, a plurality of surface electrode rows 4L are formed on the obverse surface 7*a* of the material substrate 7 at predetermined intervals in the direction y. Each of the surface electrode rows 4L is made up of a plurality of surface electrode portions 41 aligned in the direction x.

Then, a resistor layer 2 is formed on the obverse surface 7*a* of the material substrate 7. Specifically, a plurality of resistor rows 2L are formed at predetermined intervals in the direction y. Each of the resistor rows 2L is made up of a plurality of resistor strips 21. The resistor rows 2L are so formed that two ends of each resistor strip 21 in the direction y partially cover the corresponding surface electrode portions 41. Then, protective layers s are formed to cover the resistor strips 21. The protective layers s have a strip-like form extending in the direction x with a uniform width. To clearly show where the resistor strips 21 are formed, the illustration of the protective layers s is omitted in FIG. 5. For the same reason, the illustration of the protective layers s is omitted also in plan views such as FIGS. 7, 10 and 13, which show the subsequent steps of the manufacturing method.

Then, the material substrate 7 is bonded to a sheet member 61 by using e.g. an adhesive. As a result, a laminated structure made up of the sheet member 61, the adhesive layer 62 and the material substrate 7 is obtained. The sheet member 61 is made of an insulating material such as a PET film.

Figure 7:
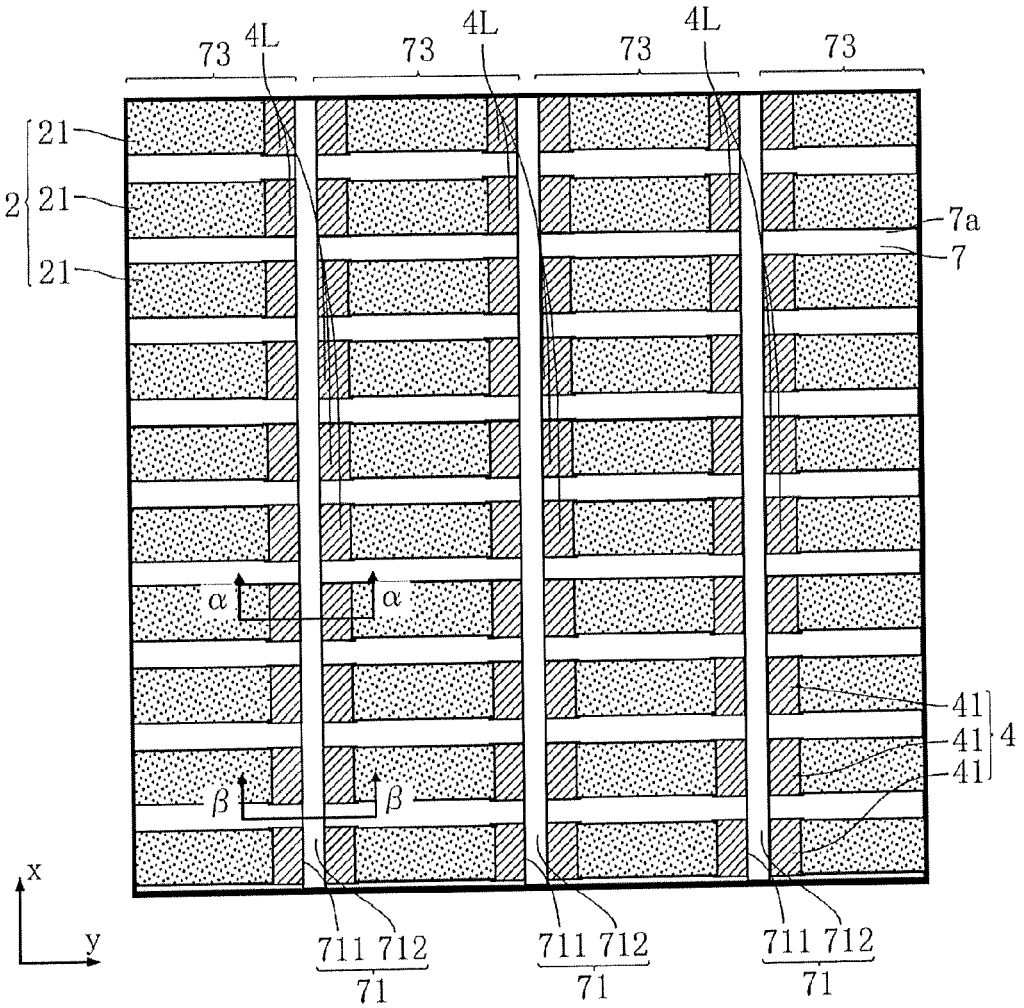
FIG. 7 is a plan view illustrating a step subsequent to the step illustrated in FIG. 5.
Figure 8:
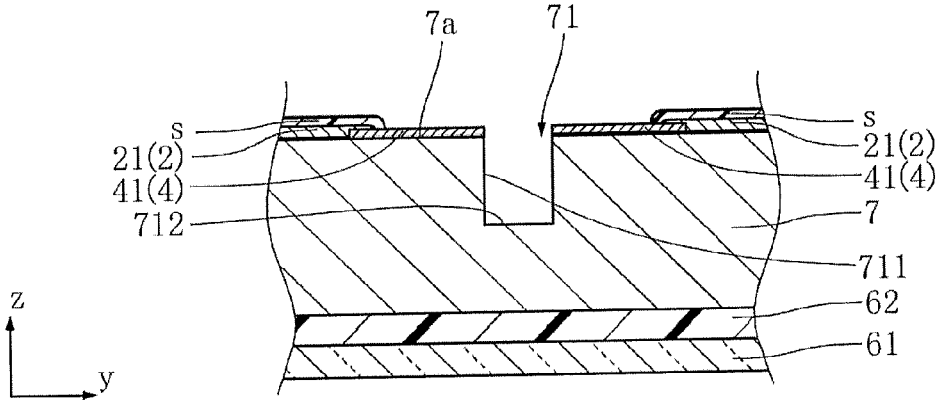
FIG. 8 is a sectional view taken along lines α-α in FIG. 7.
Figure 9:
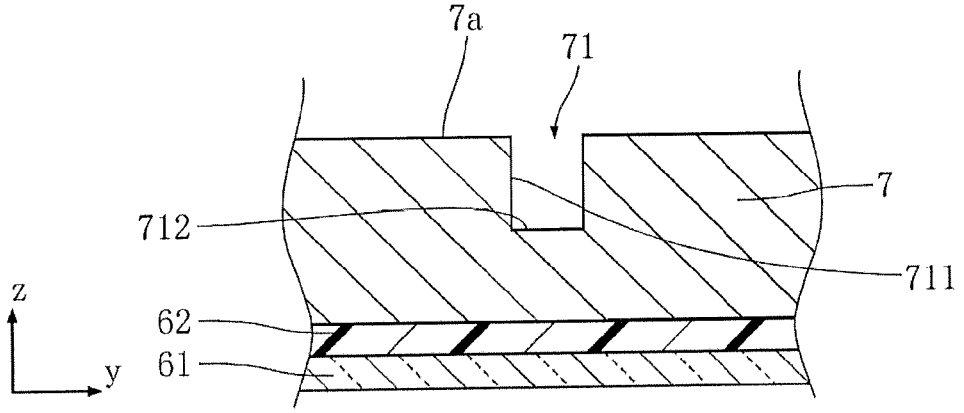
FIG. 9 is a sectional view taken along lines β-β in FIG. 7.

Then, as illustrated in FIGS. 7, 8 and 9, a plurality of grooves 71 (three grooves in FIG. 7) extending in the direction x are formed in the obverse surface 7*a* of the material substrate 7 at locations corresponding to the surface electrode rows 4L. As is clear from FIGS. 8 and 9, the grooves 71 do not penetrate the material substrate 7. Each of the grooves 71 has side surfaces 711 and a bottom surface 712 formed in the material substrate 7. As illustrated in FIG. 7, by forming the grooves 71, a plurality of substrate sections 73 each having a strip-like form extending in the direction x are defined in the material substrate 7. Four substrate sections 73 are illustrated in FIG. 7. Each groove 71 has a width (size in the direction y) of e.g. 70 to 100 μm and a depth of about 50 to 100 μm.

Figure 10:
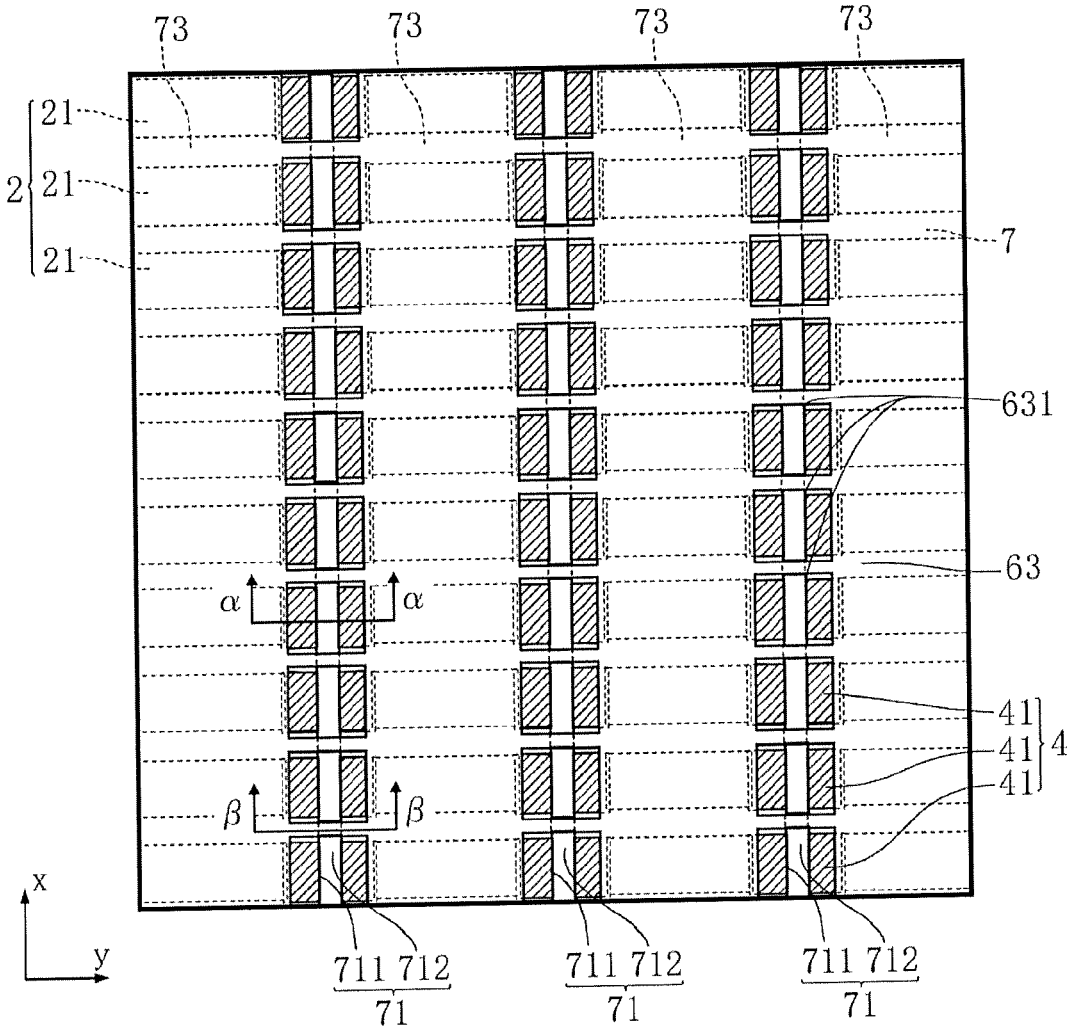
FIG. 10 is a plan view illustrating a step subsequent to the step of FIG. 7.
Figure 11:
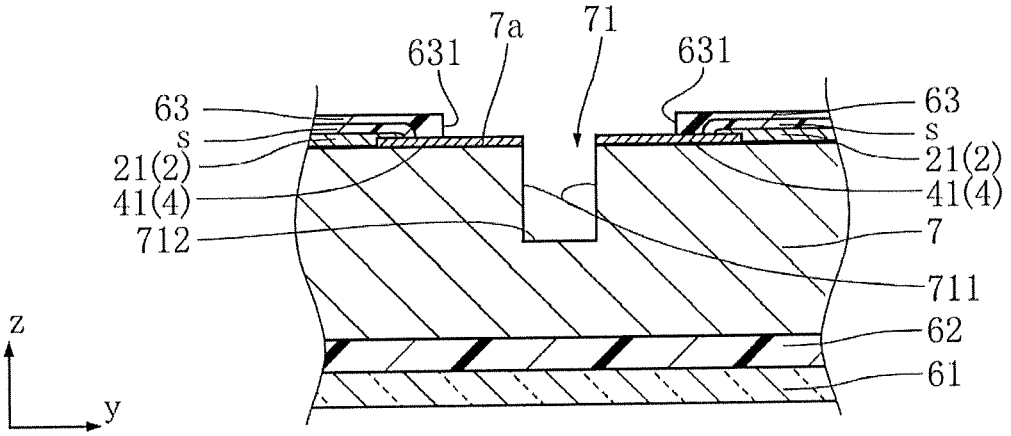
FIG. 11 is a sectional view taken along lines α-α in FIG. 10.
Figure 12:
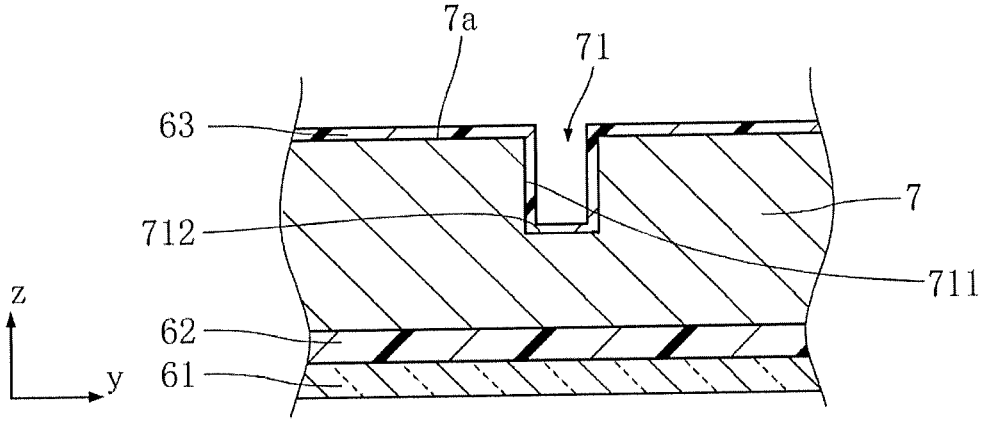
FIG. 12 is a sectional view taken along lines β-β in FIG. 10.

Then, as illustrated in FIGS. 10, 11 and 12, a masking layer 63 is formed by printing on the obverse surface 7*a* side of the material substrate 7. As illustrated in FIGS. 10 and 11, the masking layer 63 includes a plurality of rectangular openings 631. The openings 631 are aligned in the direction x, and each of the openings 631 exposes at least part of a respective surface electrode portion 41. As illustrated in FIGS. 10 and 12, the masking layer 63 covers most portions of each groove 71 which are not positioned in the midst of the surface electrode portions 41.

Figure 13:
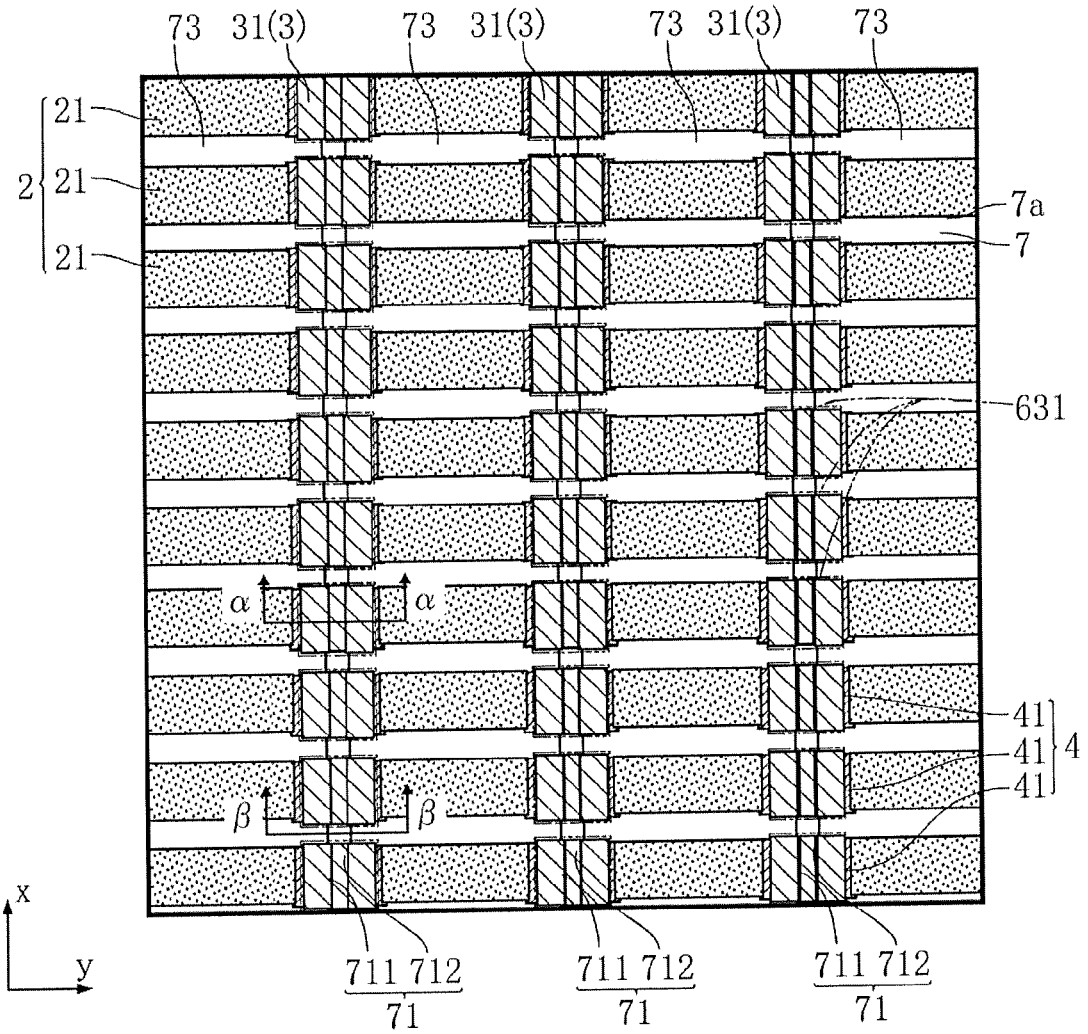
FIG. 13 is a plan view illustrating a step subsequent to the step of FIG. 10.
Figure 16:
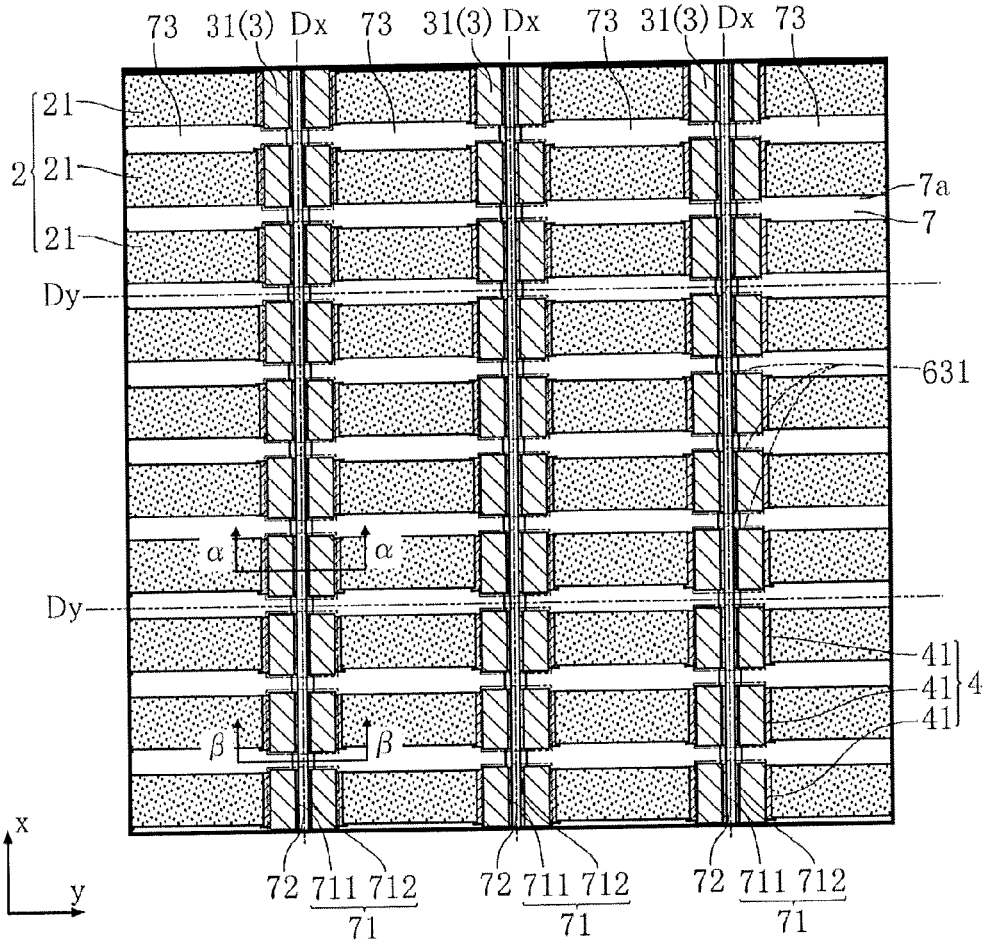
FIG. 16 is a plan view illustrating a step subsequent to the step of FIG. 13.

For easier understanding, the illustration of the masking layer 63 is omitted and only the openings 631 are indicated by double dashed lines in plan views such as FIGS. 13 and 16, which show the subsequent steps of the manufacturing method. Further, in plan views such as FIGS. 13 and 16, of the conductor layer 3 to be described later, the portions formed on the obverse surface of the masking layer 63 are not illustrated.

Figure 14:
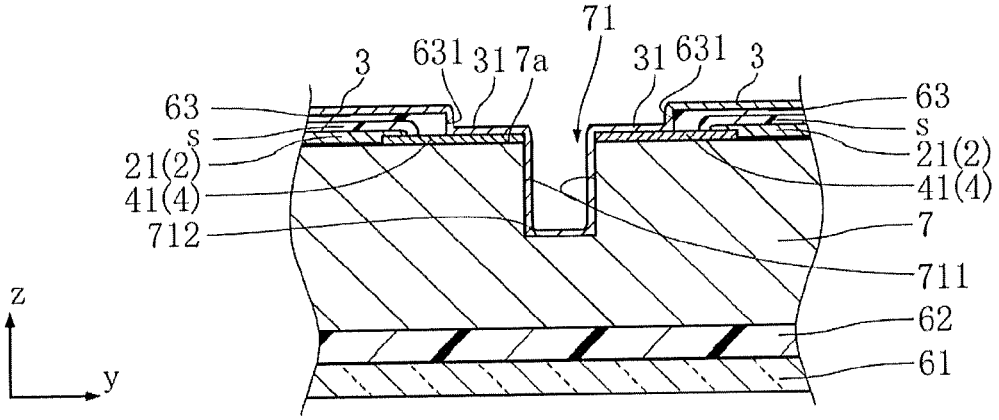
FIG. 14 is a sectional view taken along lines α-α in FIG. 13.
Figure 15:
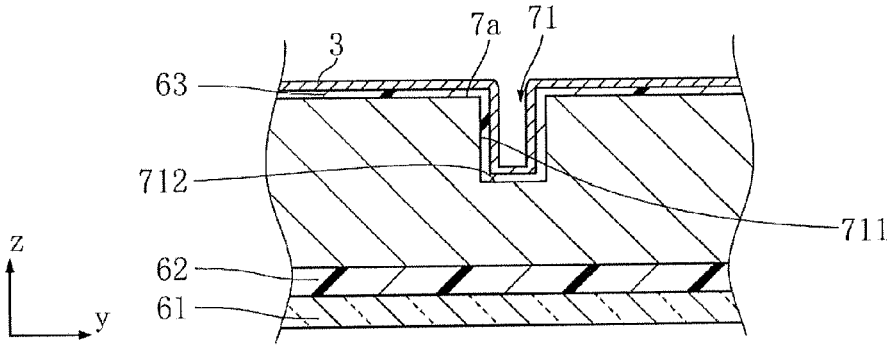
FIG. 15 is a sectional view taken along lines β-β in FIG. 13.

Then, as illustrated in FIGS. 13, 14 and 15, atoms of nickel, chrome or other conductive materials are sputtered onto the obverse surface 7*a* of the material substrate 7. By this process, as illustrated in FIGS. 13 and 14, a conductor layer 3 is formed directly on the surface electrode portions 41 and the side surfaces 711 and bottom surfaces 712 of the grooves 71*b* at portions which are not covered with the masking layer 63, i.e., exposed due to the presence of the openings 631. The conductor layer 3 formed directly on the side surfaces 711 of the grooves 71 and so on constitute a plurality of conductive portions 31 aligned in the direction x. The conductive portions 31 are rectangular in x-y plan view and spaced from each other in the direction x. As illustrated in FIGS. 14 and 15, the conductor layer 3 is formed not directly but via the masking layer 63 on the surface electrode portions 41 and the side surfaces 711 and bottom surfaces 712 of the grooves 71 at portions which are covered with the masking layer 63.

Figure 17:
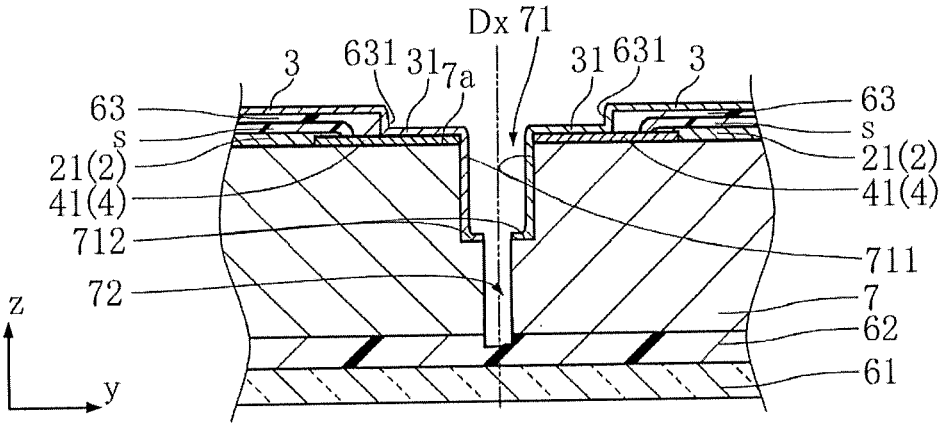
FIG. 17 is a sectional view taken along lines α-α in FIG. 16.
Figure 18:
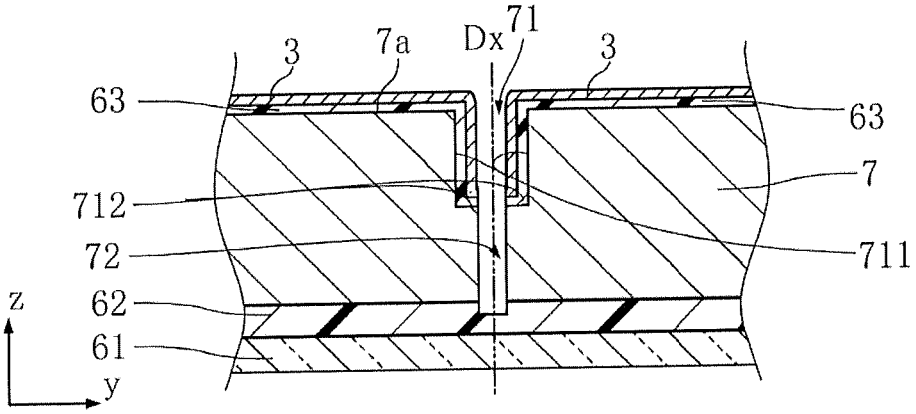
FIG. 18 is a sectional view taken along lines β-β in FIG. 16.

Then, as illustrated in FIGS. 16, 17 and 18, a separation groove 72 is formed on the bottom surface 712 of each groove 71. By this process, the substrate sections 73 are separated from each other along the lines Dx extending in the direction x in FIG. 16. The width (the size in the direction y) of the separation groove 72 is smaller than that of the bottom surface 712 of the groove 71. The width of the separation groove 72 is e.g. 40 to 60 μm. The separation groove 73 is formed by e.g. using a dicing blade. Then, each of the substrate sections 73 is divided along the lines Dy indicated in FIG. 16 by e.g. forming non-illustrated grooves. As clearly shown in FIGS. 17 and 18, in separating the substrate sections 73 from each other along the lines Dx and dividing each substrate section 73 along the lines Dy, the substrate sections 73 remain bonded to the sheet member 61 via the adhesive layer 62. By forming the separation grooves 72, a plurality of substrates 1 each including projections 11 as illustrated in FIG. 3 are formed.

Figure 19:
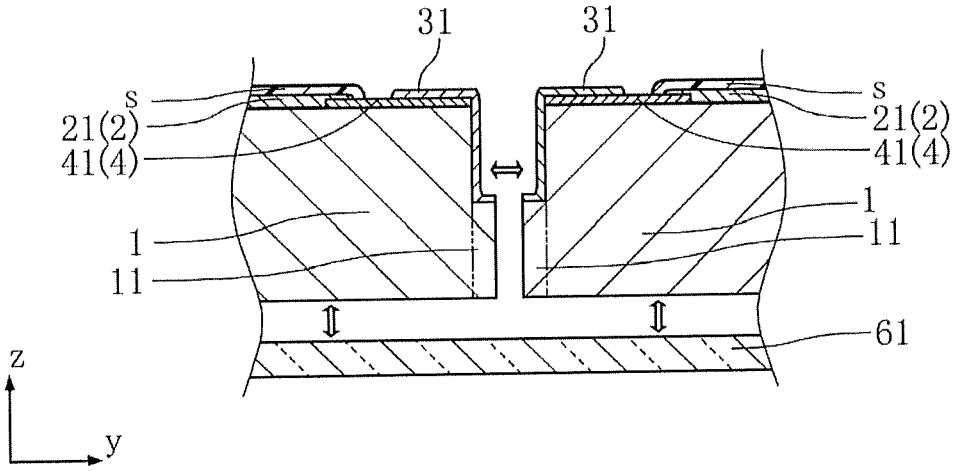
FIG. 19 is a sectional view illustrating a step subsequent to the step of FIG. 17.
Figure 20:
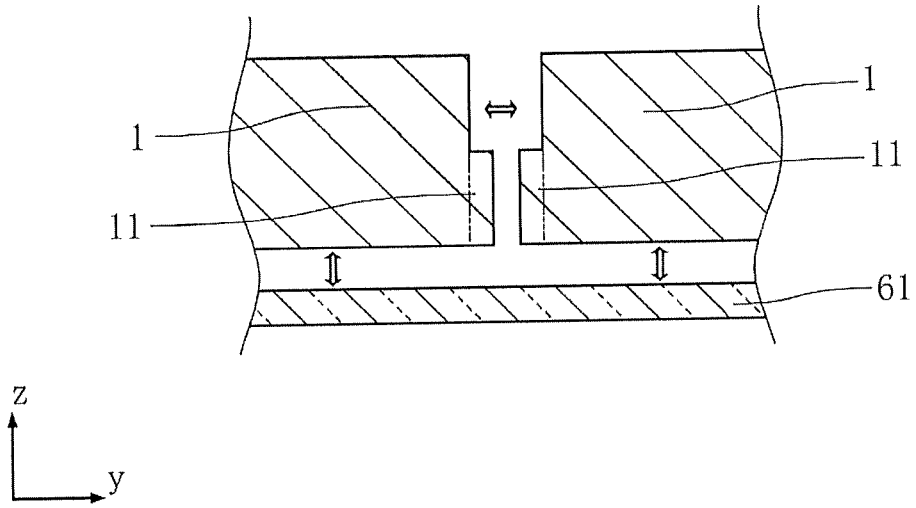
FIG. 20 is a sectional view illustrating a step subsequent to the step of FIG. 18.

Then, as illustrated in FIGS. 19 and 20, the adhesive layer 62 is dissolved by using an appropriate solvent. FIG. 19 illustrates the subsequent step in a sectional view corresponding to FIG. 17, whereas FIG. 20 illustrates the subsequent step in a sectional view corresponding to FIG. 18. By dissolving the adhesive layer 62, the plurality of substrates 1 separate from the sheet member 61 and completely separate from each other. Then, the masking layer 63 is dissolved. By this process, the conductor layer 3 formed on the masking layer 63 is removed from the substrates 1.

Then, plate layers 5 as illustrated in FIG. 3 are formed, whereby the chip resistor A1 is completed.

The advantages of the above-described chip resistor A1 and the manufacturing method are described below.

According to this embodiment, as illustrated in FIGS. 13-15, the conductor layer 3 is formed on the side surfaces 71 of the grooves 71. Thus, it is not necessary to separate and precisely rearrange the substrate sections 73 for the formation of the conductor layer 3. That is, the plurality of substrate sections 73 maintain the proper positional relationship and alignment with each other during the processes of forming the grooves 71 in the material substrate 7 and forming the conductor layer 3. This ensures that the conductor layer 3 is made with least positional deviation. Thus, the chip resistor A1 is precisely manufactured, i.e., a chip resistor A1 having a high accuracy is obtained.

Figure 46A:
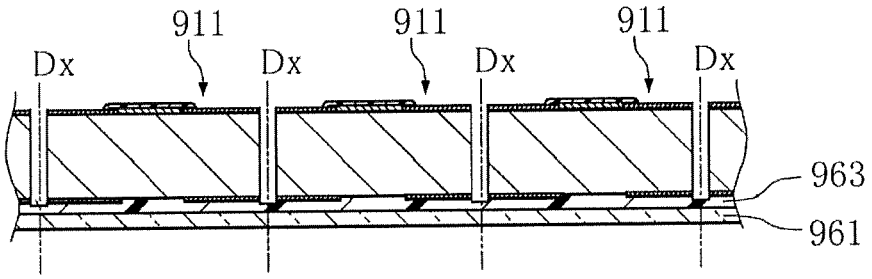
FIG. 46A Related Art
FIG. 46A illustrates a step subsequent to the step of FIG. 45A.
Figure 46B:
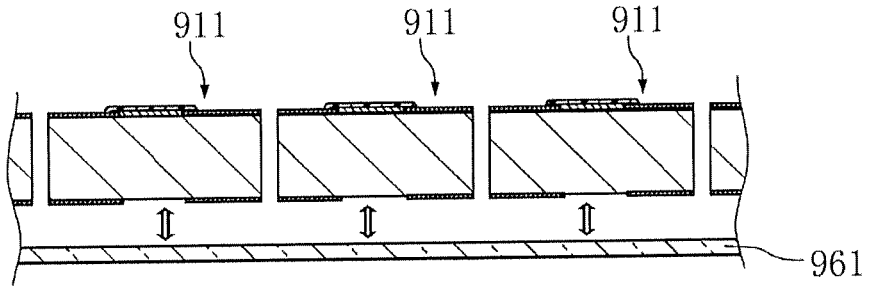
FIG. 46B Related Art
FIG. 46B illustrates a step subsequent to the step of FIG. 46A.
Figure 46C:
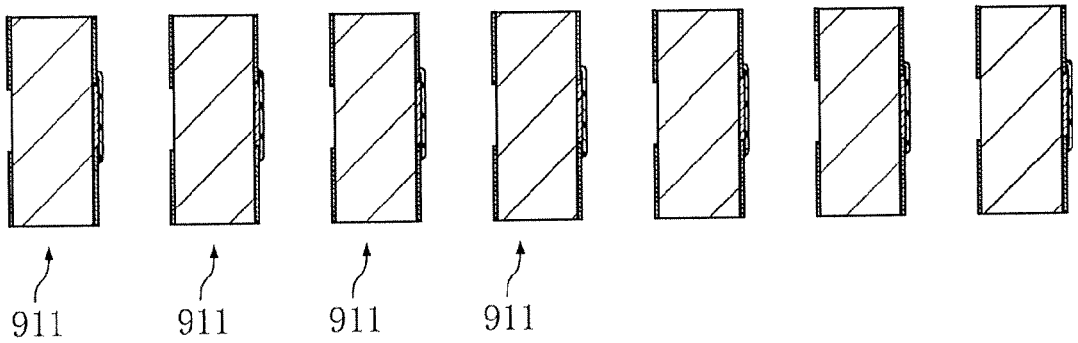
FIG. 46C Related Art
FIG. 46C illustrates a step subsequent to the step of FIG. 45B.
Figure 46D:
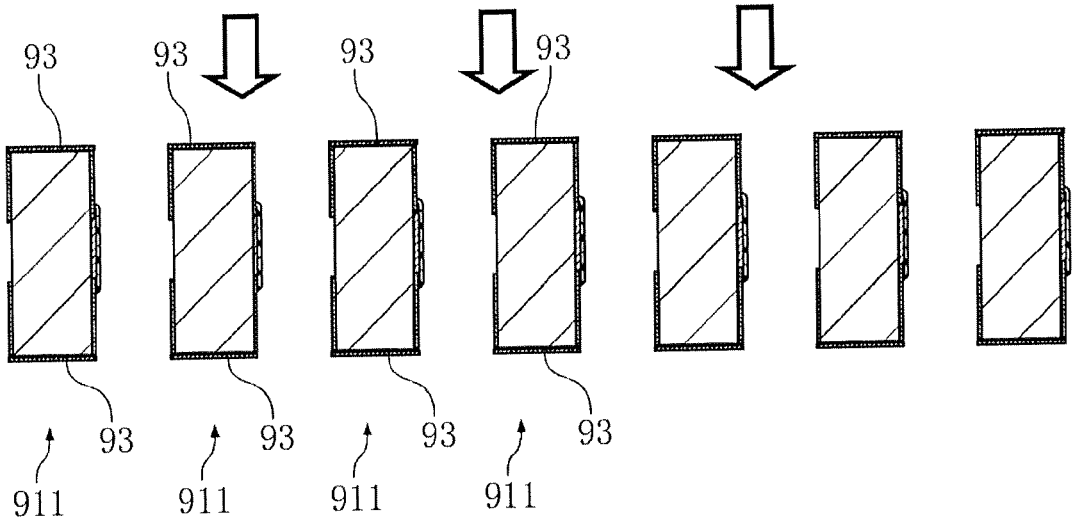
FIG. 46D Related Art
FIG. 46D illustrates a step subsequent to the step of FIG. 45C.

As noted before with reference to FIGS. 46B and 46C, the method as related art requires a highly precise technique to rearrange the bar members 911 into a proper posture after the removal from the sheet member 961, and it is difficult to rearrange extremely thin bar members 911. In contrast, the method of this embodiment does not require such a highly precise technique, because it is not necessary to separate and rearrange the substrate sections 73. Thus, the method of this embodiment ensures that smaller chip resistors can be manufactured readily.

As illustrated in FIGS. 11 and 12, each groove 71 formed in the material substrate 7 has a bottom surface 712 and does not penetrate the material substrate 7. In other words, the depth of the groove 71 is smaller than when the groove 71 penetrates the material substrate 7. Thus, the masking layer 63 is reliably formed on the bottom surface 712 of the groove 71 by printing. This prevents unintentional formation of the conductor layer 3 at an improper portion of the side surfaces 711 of the groove 71.

Thus, as illustrated in FIG. 13, the conductor layer 3 including conductive portions 31 spaced from each other in the direction x is properly formed. This method is particularly suitable for manufacturing what is called a multiple-type chip resistor including a plurality of resistor strips 21.

The interval in the direction x between the lines Dy (see FIG. 16), along which the material substrate 1 is to be divided, can be changed appropriately. By changing the interval, a multiple-type chip resistor in which the number of resistor strips 21 is not four or a single-type chip resistor including only one resistor strip 21 is easily obtained.

As described with reference to FIGS. 16-18, in this embodiment, the width of the separation groove 72 is set smaller than that of the groove 71. That is, in separating the substrate sections 73 from each other by forming the separation groove 72 using a non-illustrated dicing blade, the dicing blade does not easily come into contact with the conductor layer 3 on the side surfaces of the groove 71. Thus, the conductor layer 3 is not easily chipped off in the separation process.

As illustrated in FIGS. 7-12, the masking layer 63 is formed after the grooves 71 are formed, not before. Thus, the dimension of the grooves 71 in the direction y and that of the openings 631 of the masking layer 63 do not need to be set equal to each other. As illustrated in FIGS. 10 and 11, the dimension of the openings 631 in the direction y is larger than that of the grooves 71 so that the conductor layer 3 is formed not only on the side surfaces 71 of the grooves 71 but also on the obverse surface 1*a* side of the substrate 1, as illustrated in FIGS. 13 and 14. This ensures that the conductor layer 3 comes into sufficient contact with the surface electrode layer 4.

As illustrated in FIG. 4, the fillet f is formed to come into contact with the entirety of the plate layer 5 on the side surface 1*c* side of the substrate 1. The fillet f is not so large as to come into contact with the reverse surface 1*b* of the substrate 1 and not so large also in the direction y. Thus, the mounting area of the chip resistor A1 including the size of the solder fillet f is reduced.

Figure 21:
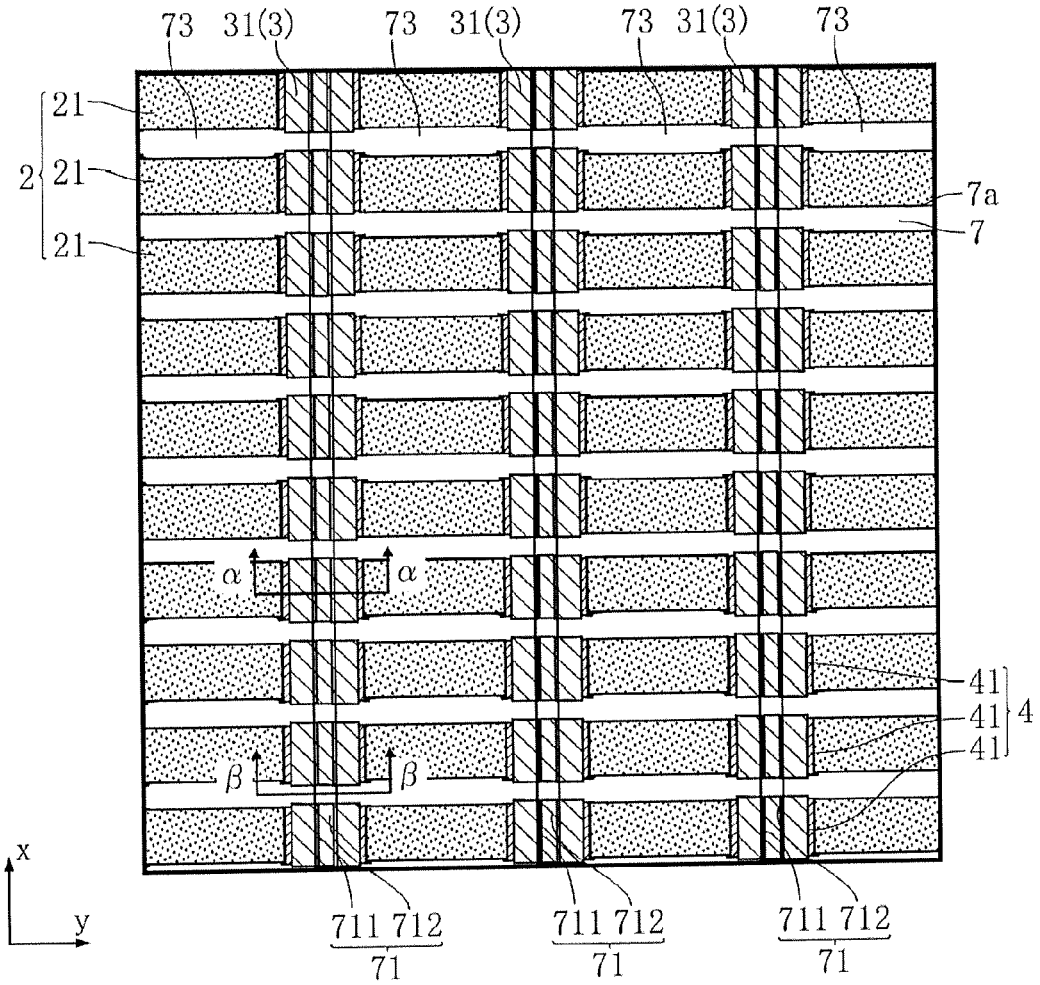
FIG. 21 is a plan view illustrating a variation of the chip resistor manufacturing method according to the first embodiment of the present invention.
Figure 22:
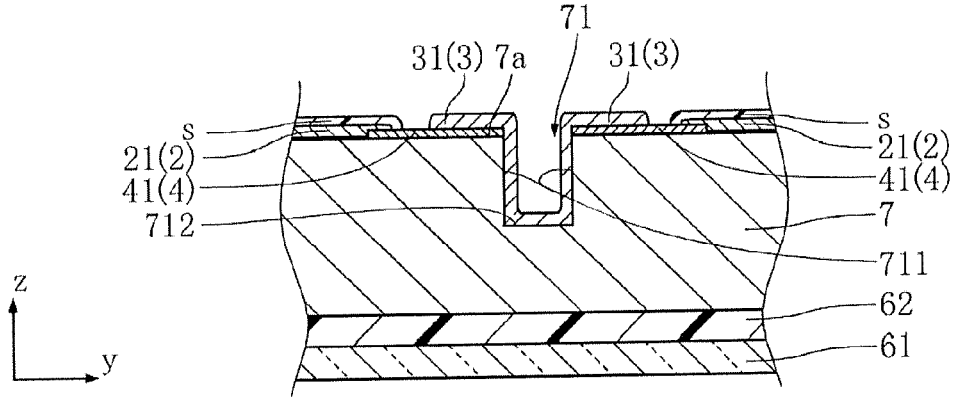
FIG. 22 is a sectional view taken along lines α-α in FIG. 21.
Figure 23:
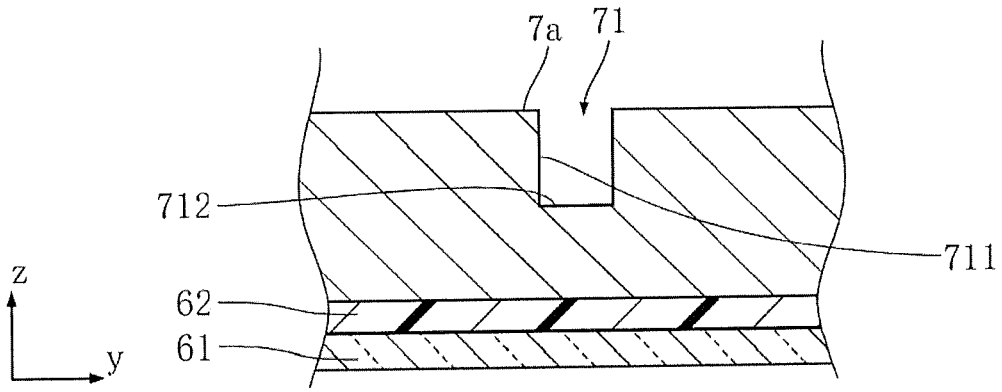
FIG. 23 is a sectional view taken along lines β-β in FIG. 21.

FIGS. 21-23 illustrate a variation of the manufacturing method of this embodiment. In this variation, the conductor layer 3 is formed by printing, instead of sputtering after the formation of a masking layer 63 as described with reference to FIGS. 7-12.

With this method, as illustrated in FIGS. 21-23, the conductor layer 3 is reliably formed on a desired portion of the side surfaces 711 and the bottom surface 712 of each groove 71 without forming a masking layer. Specifically, as illustrated in FIGS. 21 and 22, the conductor layer 3 is formed only in small regions which are square as viewed in x-y plane, without forming a masking layer. As illustrated in FIGS. 21 and 23, the conductor layer 3 is not formed on other portions. Since this method does not include the step of forming a masking layer, the number of process steps for forming the chip resistor A1 is smaller. Further, with this method again, the conductor layer 3 is reliably formed on the bottom surface 712 of the groove 71, because the depth of the groove 71 is relatively small as noted before.

FIGS. 24-39 illustrate a second embodiment of the present invention. In these figures, the elements which are identical or similar to those of the foregoing embodiment are designated by the same reference signs as those used for the foregoing embodiment.

Figure 24:
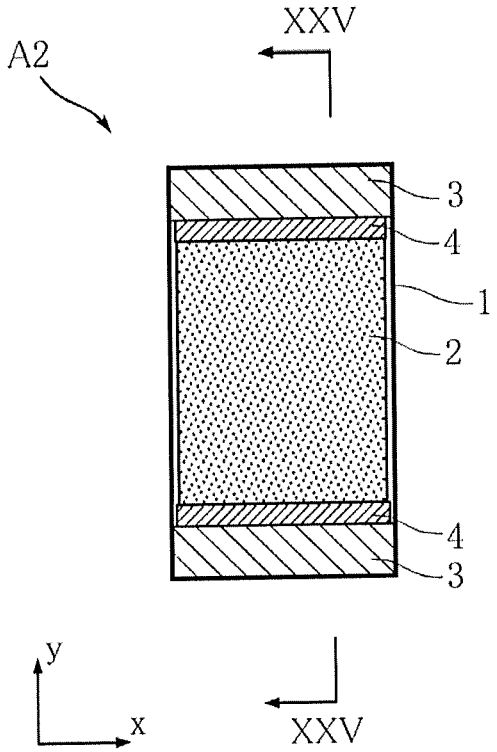
FIG. 24 is a plan view illustrating a chip resistor according to a second embodiment of the present invention.
Figure 25:
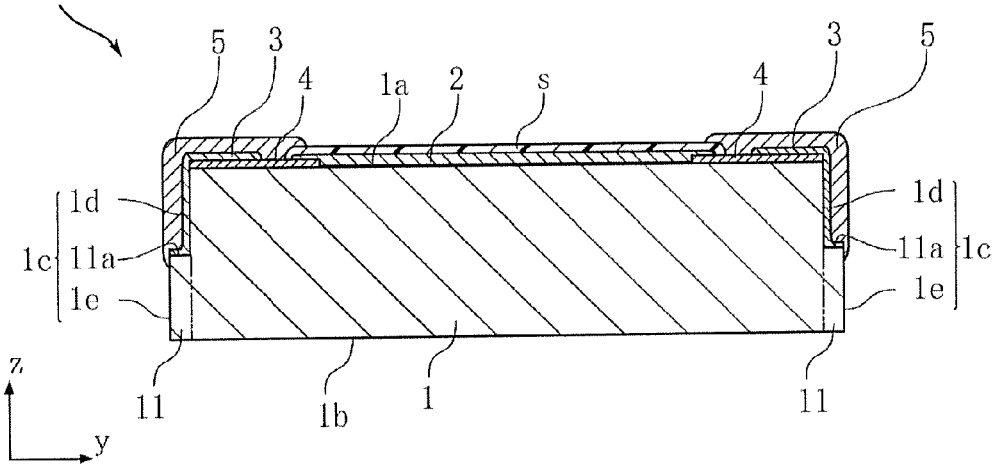
FIG. 25 is a sectional view taken along lines XXV-XXV in FIG. 24.

FIG. 24 is a plan view illustrating a chip resistor according to the second embodiment of the present invention. FIG. 25 is a sectional view taken along lines XXV-XXV in FIG. 24. The chip resistor A2 illustrated in these figures is what is called a single-type chip resistor in which the resistor layer 2 comprises only one rectangular resistor strip 21, which is the main difference from the chip resistor A1 of the first embodiment. Since the chip resistor A2 includes only one resistor strip 21, the conductor layer 3 and the surface electrode layer 4 on each edge of the substrate 1 also comprise a single conductive portion and a single surface electrode portion, respectively. A plate layer 5 is provided on each edge of the substrate 1. For easier understanding, the illustration of the protective layer s and the plate layers 5 is omitted in FIG. 24.

A method of manufacturing the chip resistor A2 is described below with reference to FIGS. 26-39.

Figure 26:
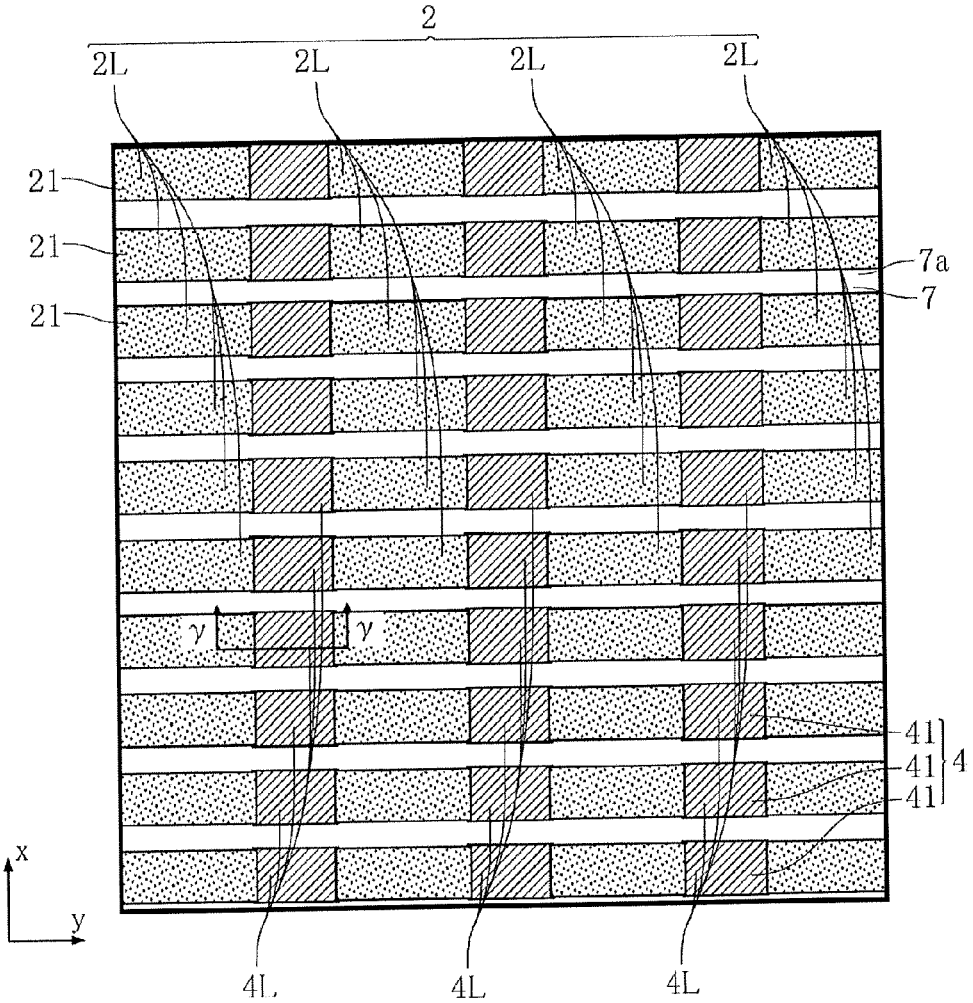
FIG. 26 is a plan view illustrating a step of the method of manufacturing the chip resistor shown in FIG. 24.
Figure 27:
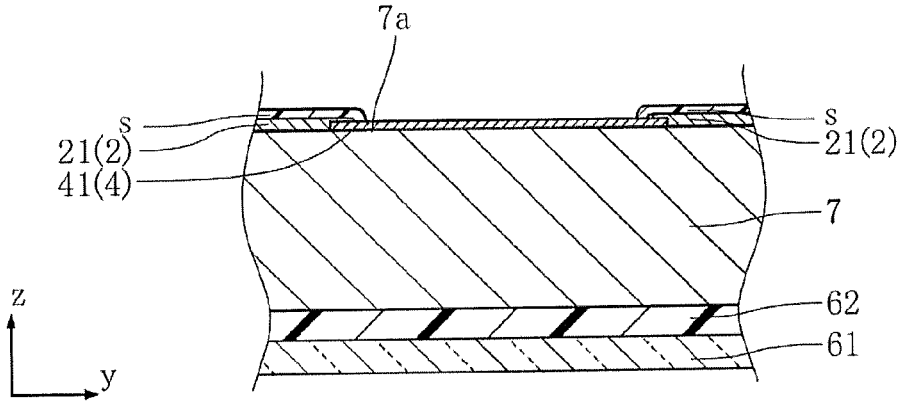
FIG. 27 is a sectional view taken along lines γ-γ in FIG. 26.

First, similarly to the first embodiment, a material substrate 7 is prepared, and a surface electrode layer 4 is formed on the obverse surface 7*a* of the material substrate 7, as illustrated in FIGS. 26 and 27. Specifically, a plurality of surface electrode rows 4L are formed on the obverse surface 7*a* of the material substrate 7 at predetermined intervals in the direction y. Each of the surface electrode rows 4L is made up of a plurality of surface electrode portions 41.

Then, similarly to the first embodiment, a resistor layer 2 is formed on the obverse surface 7*a* of the material substrate 7. Specifically, a plurality of resistor rows 2L are formed at predetermined intervals in the direction y. Each of the resistor rows 2L is made up of a plurality of resistor strips 21. The resistor rows 2L are so formed that two ends of each resistor strip 21 in the direction y partially cover the corresponding surface electrode portions 41. Then, protective layers s are formed to cover the resistor strips 21. The protective layers s have a strip-like form extending in the direction x with a uniform width. To clearly show where the resistor strips 21 are formed, the illustration of the protective layers s is omitted in FIG. 26. For the same reason, the illustration of the protective layers s is omitted also in plan views such as FIGS. 28, 31 and 34, which show the subsequent steps of the manufacturing method.

Then, the material substrate 7 is bonded to a sheet member 61 by using e.g. an adhesive. As a result, a laminated structure made up of the sheet member 61, the adhesive layer 62 and the material substrate 7 is obtained.

Figure 28:
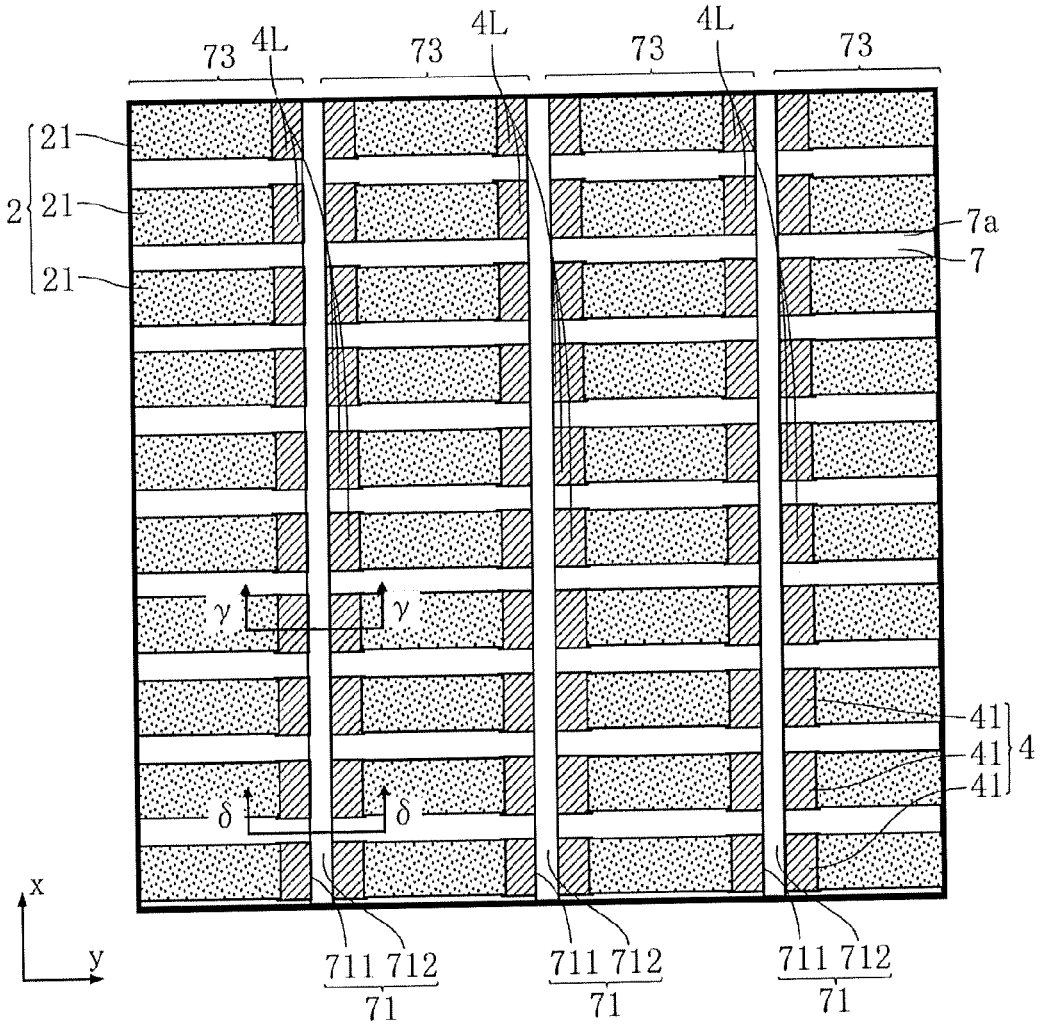
FIG. 28 is a plan view illustrating a step subsequent to the step of FIG. 26.
Figure 29:
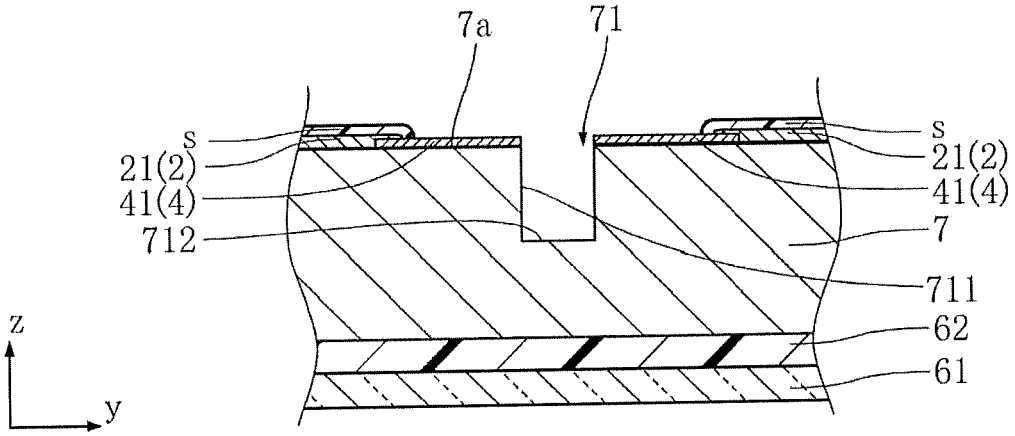
FIG. 29 is a sectional view taken along lines γ-γ in FIG. 28.
Figure 30:
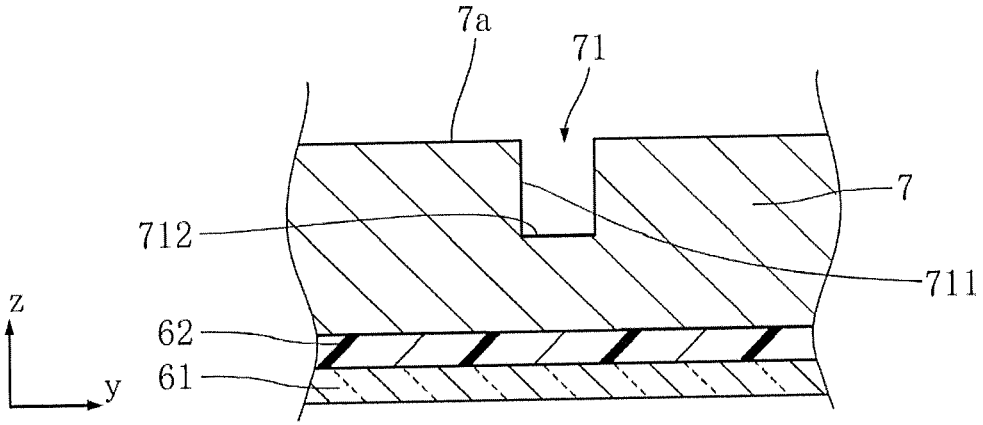
FIG. 30 is a sectional view taken along lines δ-δ in FIG. 28.

Then, as illustrated in FIGS. 28, 29 and 30, a plurality of grooves 71 extending in the direction x are formed in the obverse surface 7*a* of the material substrate 7 at locations corresponding to the surface electrode rows 4L. As is clear from FIGS. 29 and 30, the grooves 71 do not penetrate the material substrate 7. Each of the grooves 71 includes side surfaces 711 and a bottom surface 712 formed in the material substrate 7. As illustrated in FIG. 28, by forming the grooves 71, a plurality of substrate sections 73 each having a strip-like form extending in the direction x are defined in the material substrate 7. The above-described process is the same as that of the first embodiment.

Figure 31:
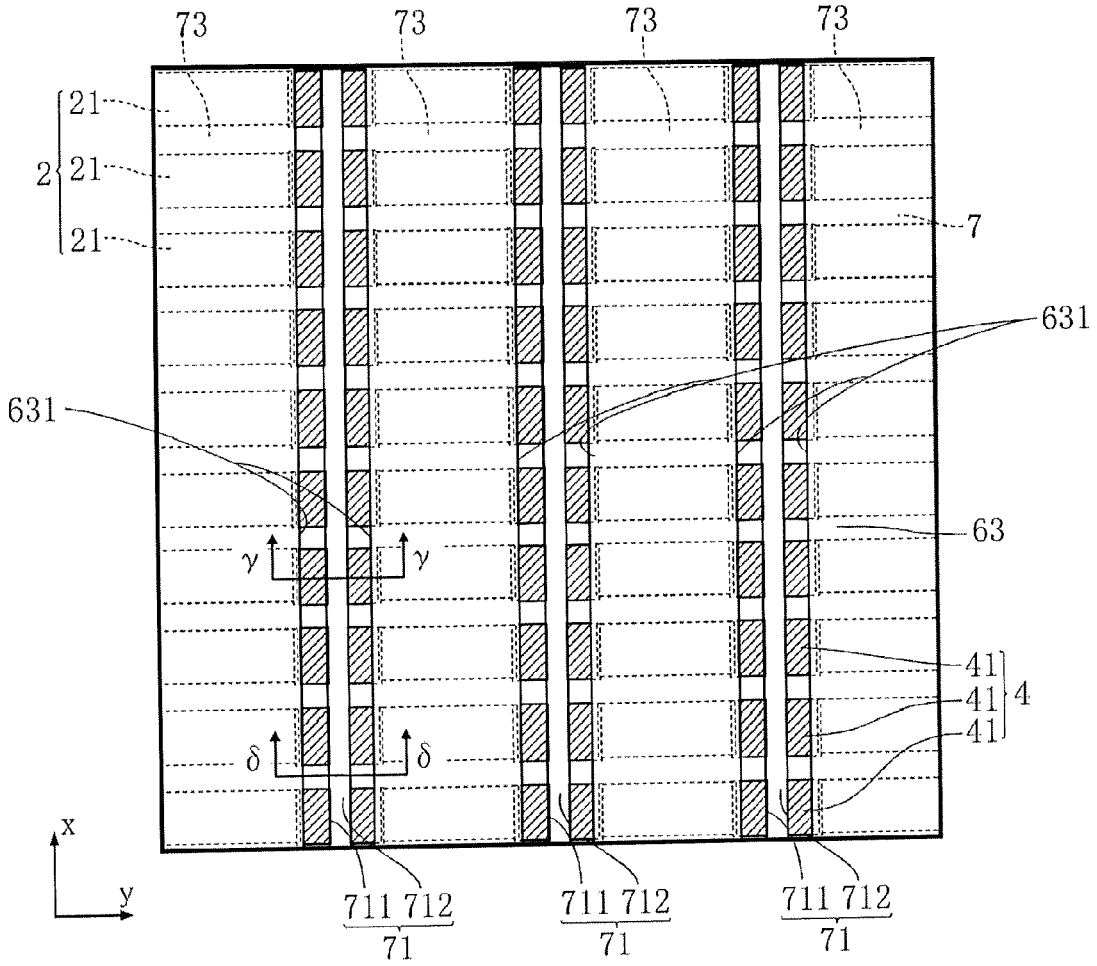
FIG. 31 is a plan view illustrating a step subsequent to the step of FIG. 28.
Figure 32:
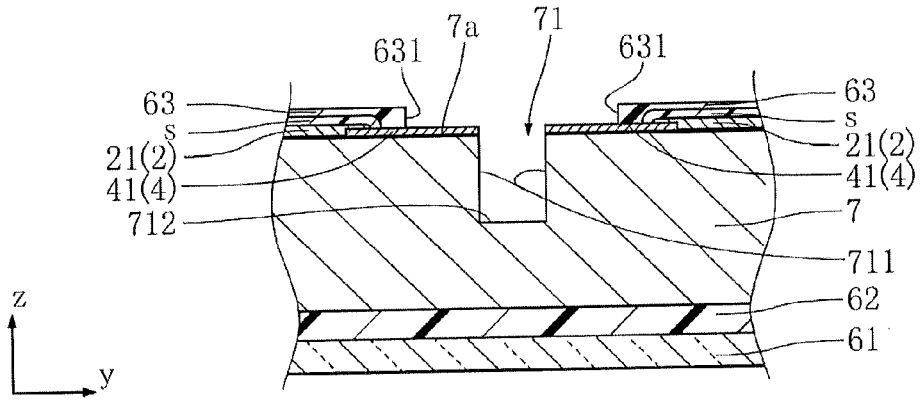
FIG. 32 is a sectional view taken along lines γ-γ in FIG. 31.
Figure 33:
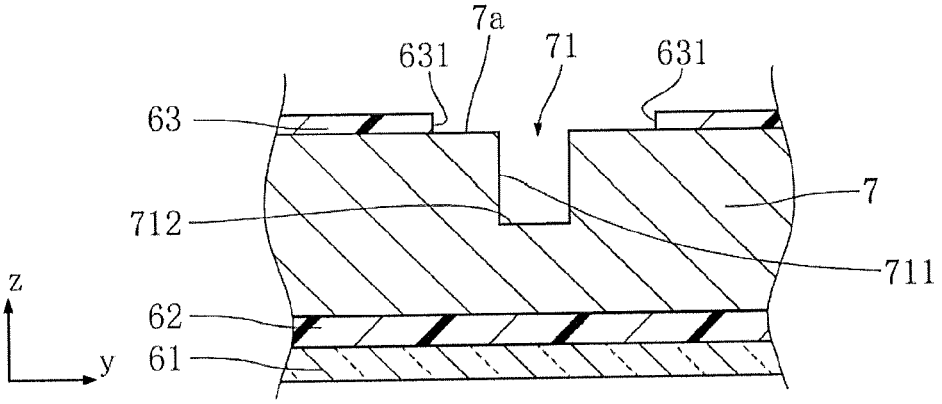
FIG. 33 is a sectional view taken along lines δ-δ in FIG. 31.

Then, as illustrated in FIGS. 31, 32 and 33, a masking layer 63 is formed on the obverse surface 7*a* of the material substrate 7. The masking layer 63 includes a plurality of openings 631 each having a strip-like form extending in the direction x. Each of the openings 631 exposes the surface electrode portions 41 at regions adjacent to the groove 71.

Figure 34:
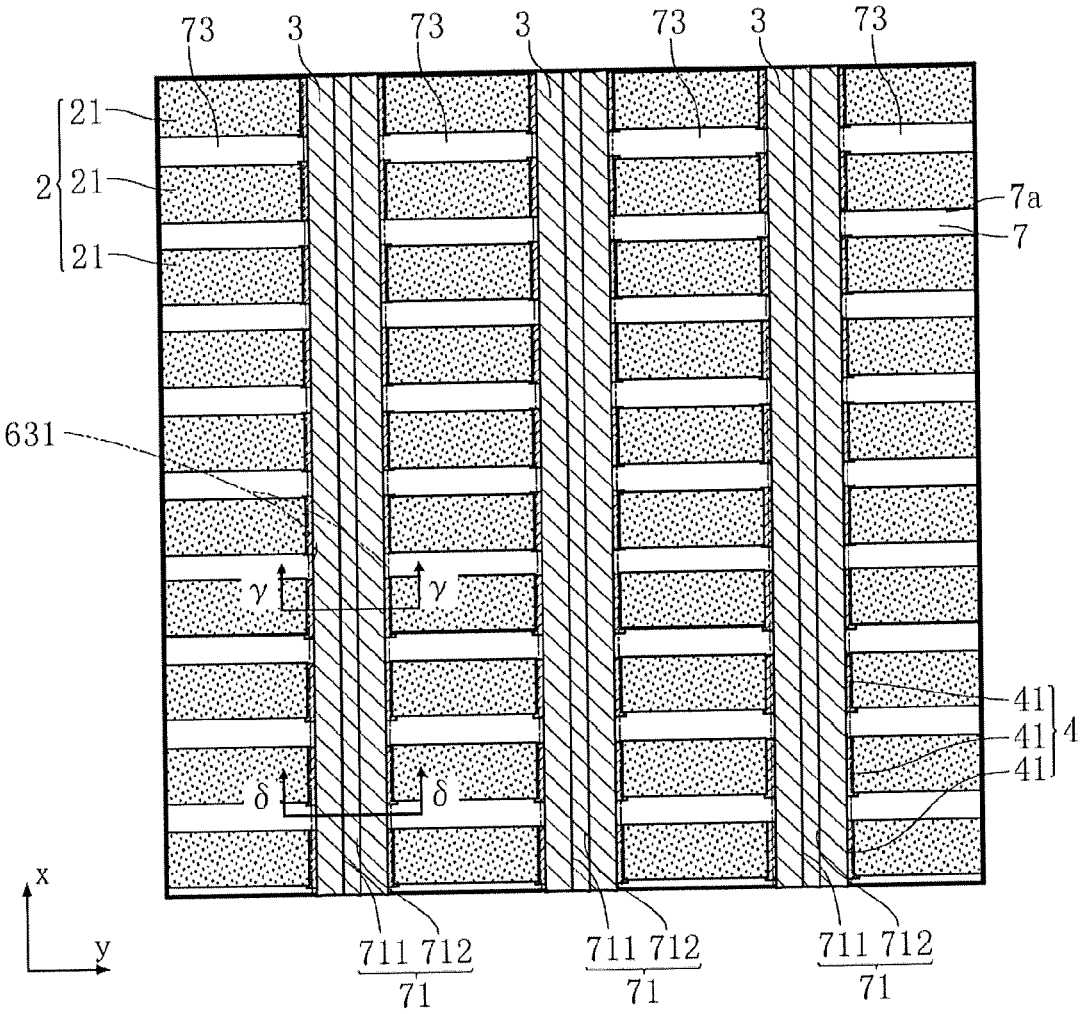
FIG. 34 is a plan view illustrating a step subsequent to the step of FIG. 31.
Figure 37:
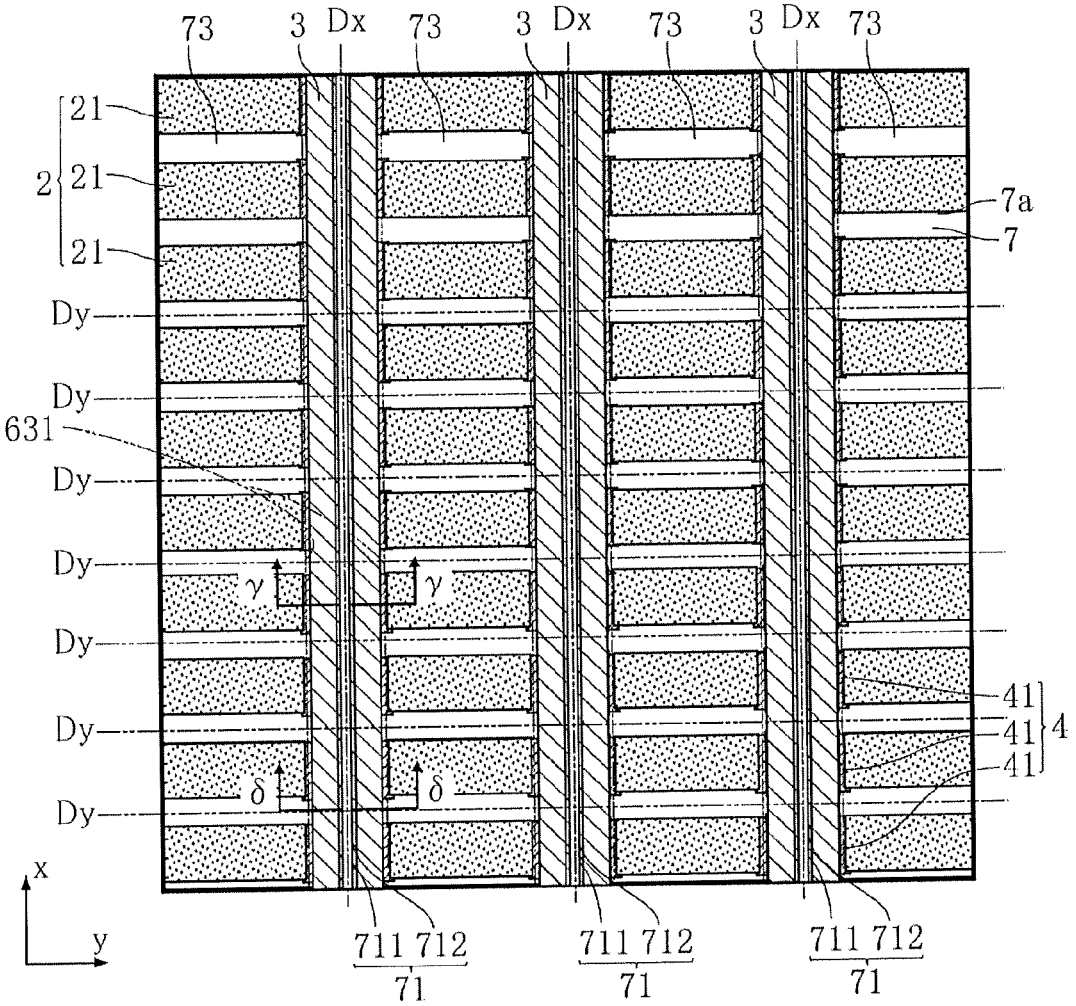
FIG. 37 is a plan view illustrating a step subsequent to the step of FIG. 34.

For easier understanding, the illustration of the masking layer 63 is omitted and only the openings 631 are indicated by double dashed lines in plan views such as FIGS. 34 and 37, which show the subsequent steps of the manufacturing method. Further, in plan views such as FIGS. 34 and 37, of the conductor layer 3 to be described later, the portions formed on the obverse surface of the masking layer 63 are not illustrated.

Figure 35:
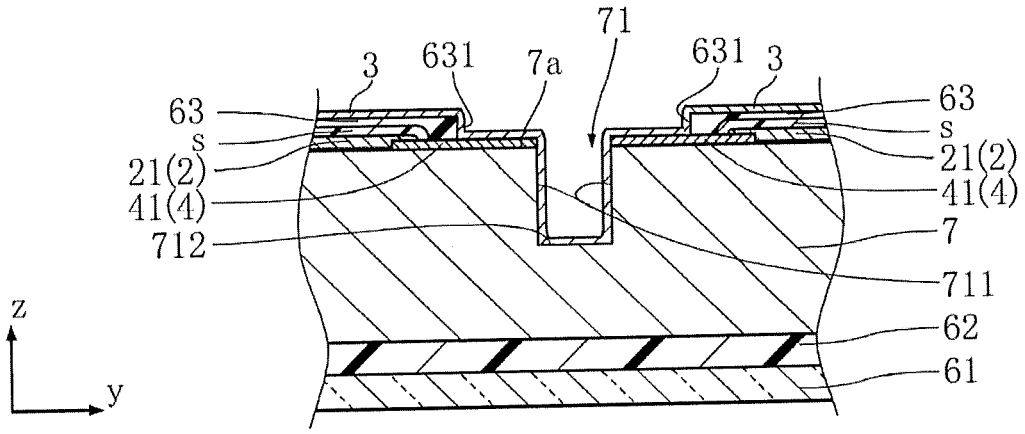
FIG. 35 is a sectional view taken along lines γ-γ in FIG. 34.
Figure 36:
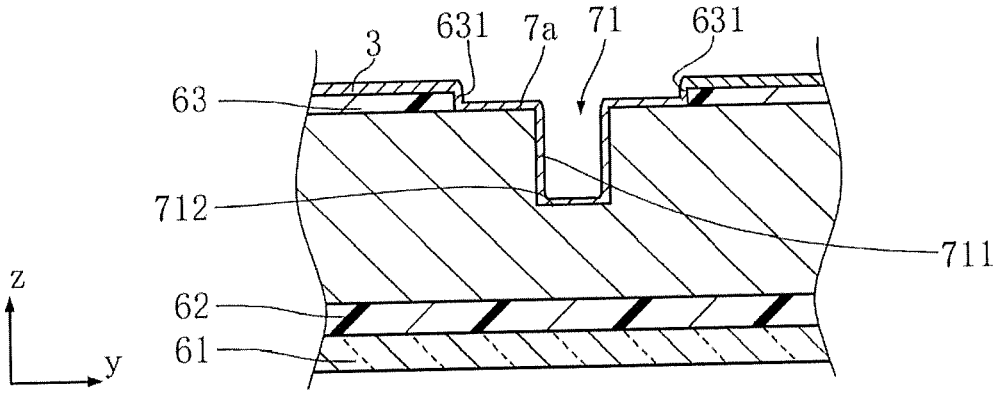
FIG. 36 is a sectional view taken along lines δ-δ in FIG. 34.

Then, as illustrated in FIGS. 34, 35 and 36, atoms of a conductive material are sputtered onto the obverse surface 7*a* of the material substrate 7. By this process, a conductor layer 3 is formed on the side surfaces 711 and bottom surfaces 712 of each groove 71 throughout the length in the direction x. The conductor layer is formed also on the surface electrode portions 41 at regions which are not covered with the masking layer 63, i.e., exposed due to the presence of the openings 631.

Figure 38:
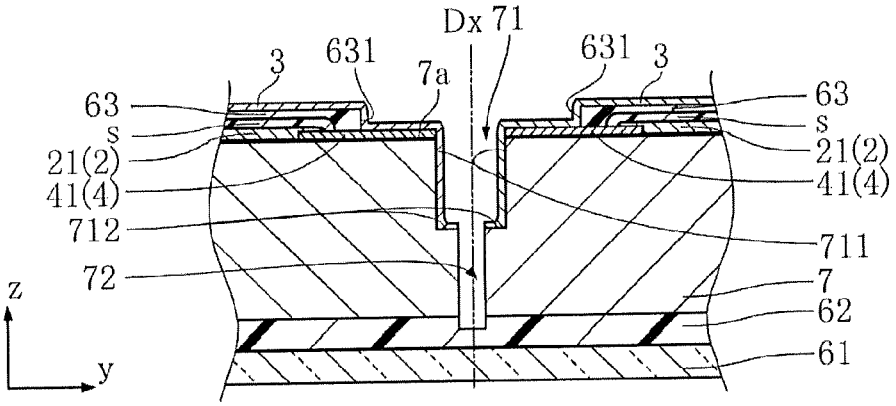
FIG. 38 is a sectional view taken along lines γ-γ in FIG. 37.
Figure 39:
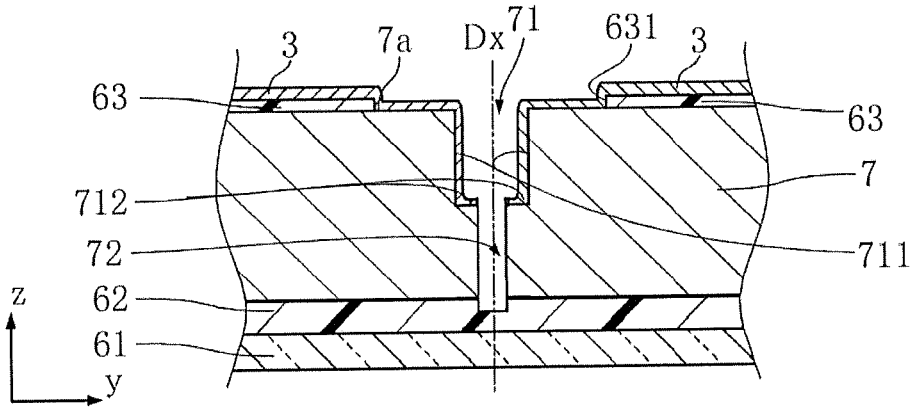
FIG. 39 is a sectional view taken along lines δ-δ in FIG. 37.

Then, as illustrated in FIGS. 37, 38 and 39, a separation groove 72 is formed on the bottom surface 712 of each groove 71. By this process, the substrate sections 73 are separated from each other along the lines Dx. Then, by performing the same process steps as those of the first embodiment such as dividing each substrate section 73 along the lines Dy, the chip resistors A2 as illustrated in FIGS. 24 and 25 are completed.

The advantages of the above-described chip resistor A2 and the manufacturing method are described below.

In this embodiment again, part of the conductor layer 3 is formed on the side surfaces 711 of each groove 71. Similarly to the first embodiment, this ensures the production of a chip resistor A2 having a high accuracy. Other advantages of the first embodiment are provided also by this embodiment.

Similarly to the variation illustrated in FIGS. 21-23, the conductor layer 3 of this embodiment may also be formed by printing, instead of sputtering after the formation of a masking layer 63 as described with reference to FIGS. 31-36.

FIGS. 40-44 illustrate a third embodiment of the present invention. In these figures, the elements which are identical or similar to those of the foregoing embodiments are designated by the same reference signs as those used for the foregoing embodiments.

Figure 40:
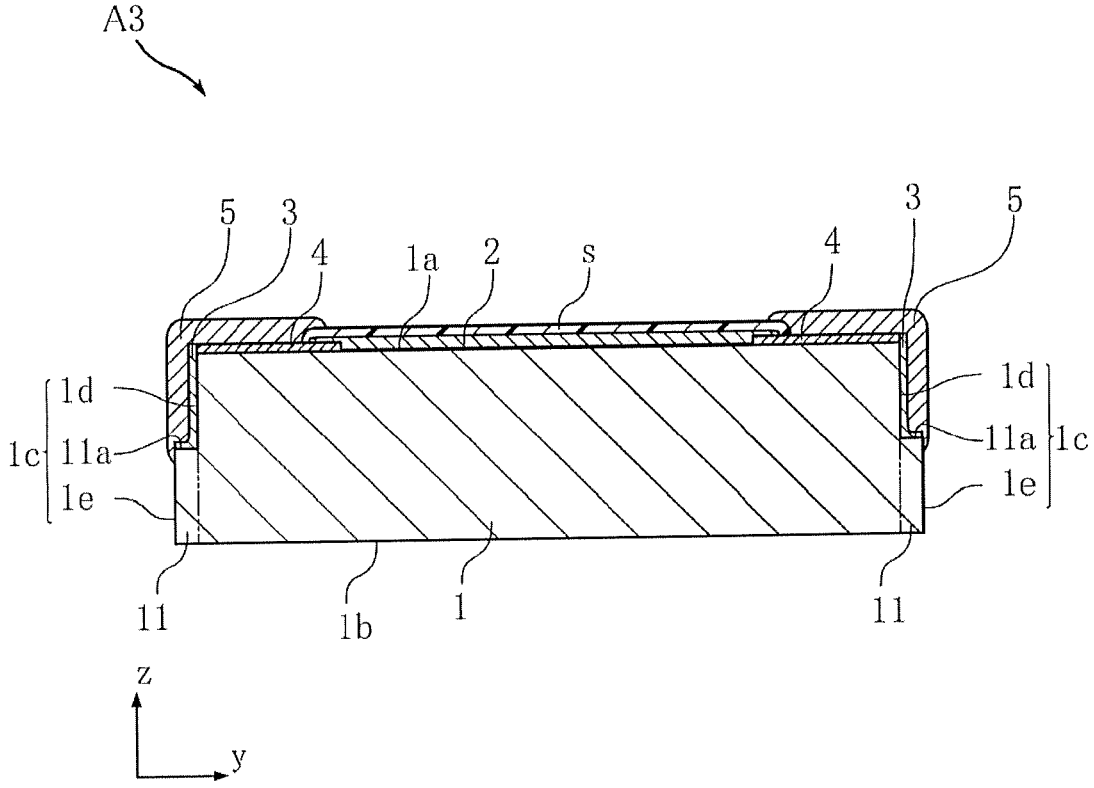
FIG. 40 is a sectional view illustrating a chip resistor according to a third embodiment of the present invention.

FIG. 40 is a sectional view, which corresponds to FIG. 25 of the second embodiment, illustrating a chip resistor A3 according to this embodiment. The chip resistor A3 differs from the chip resistor A2 of the second embodiment in that the conductor layers 3 are not formed on the surface electrode layers 4.

A method of manufacturing the chip resistor A3 is described below with reference to FIGS. 41-44. FIGS. 41-44 are sectional views corresponding to the sectional views taken along lines γ-γ in FIGS. 26, 28 and so on. In the method of manufacturing the chip resistor A3, the step of forming a masking layer 63 (see FIG. 41) and the step of forming grooves 71 (see FIG. 42) are performed in the reverse order to that of the manufacturing method of the chip resistor A2 (see FIGS. 29 and 32).

Figure 41:
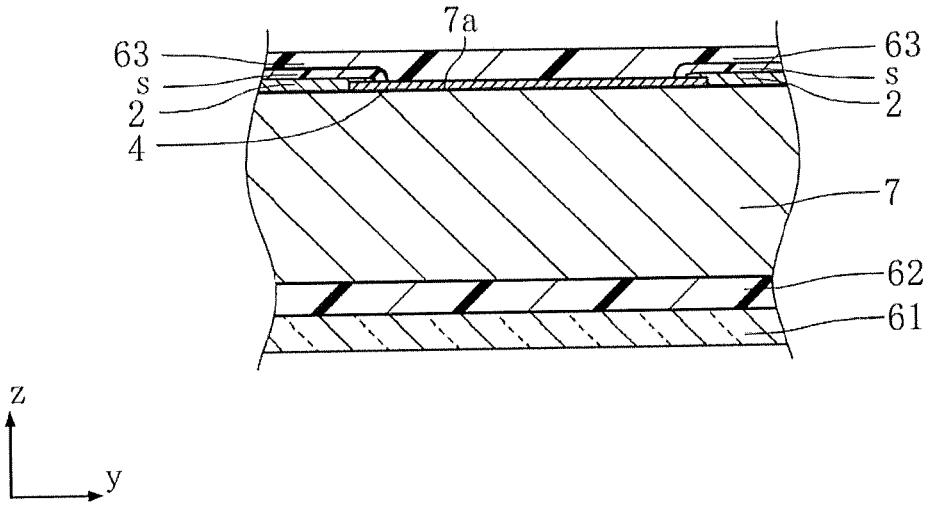
FIG. 41 illustrates a step of a method of manufacturing the chip resistor shown in FIG. 40.

Specifically, as illustrated in FIG. 41, a surface electrode layer 4 and a resistor layer 2 are formed on the obverse surface 7*a* of a material substrate 7, and then the material substrate 7 is bonded to a sheet member 61, similarly to the steps described with reference to FIGS. 26 and 27 as to the second embodiment. Then, a masking layer 63 is formed on the obverse surface 7*a* of the material substrate 7.

Figure 42:
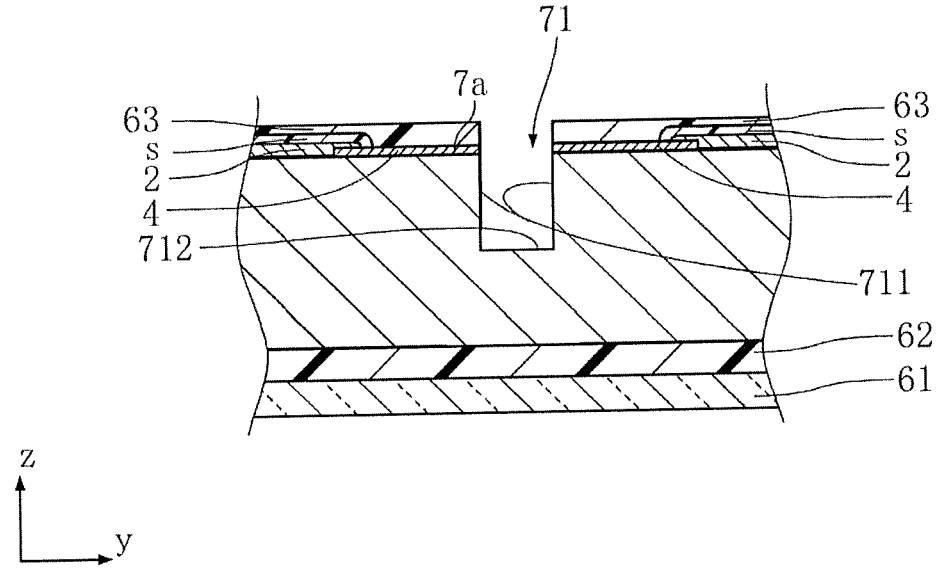
FIG. 42 illustrates a step subsequent to the step of FIG. 41.
Figure 43:
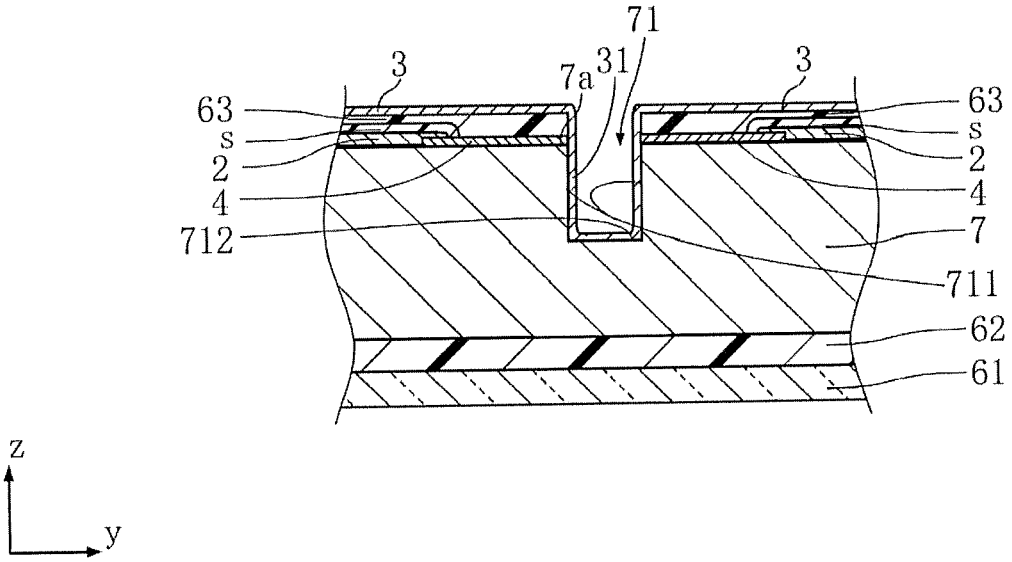
FIG. 43 illustrates a step subsequent to the step of FIG. 42.
Figure 44:
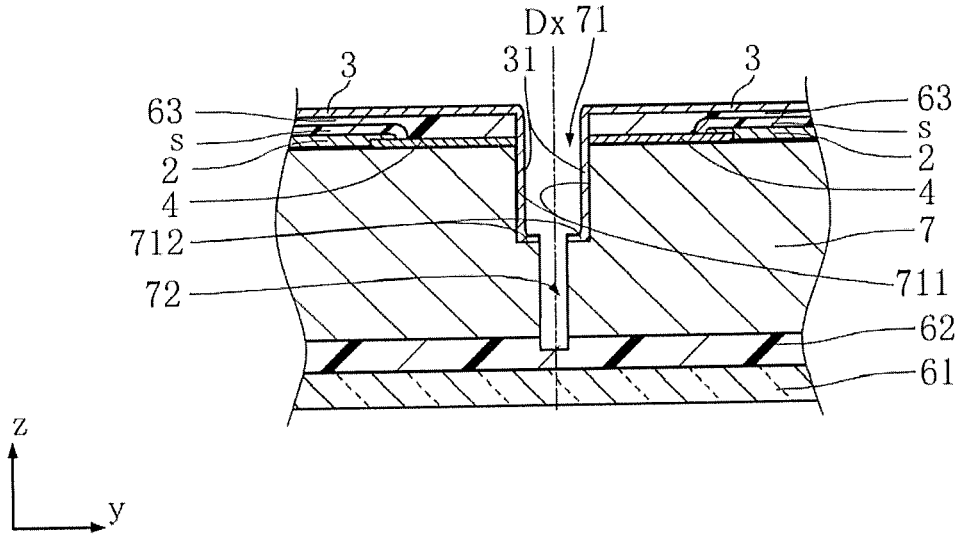
FIG. 44 illustrates a step subsequent to the step of FIG. 43.
Figure 45A:
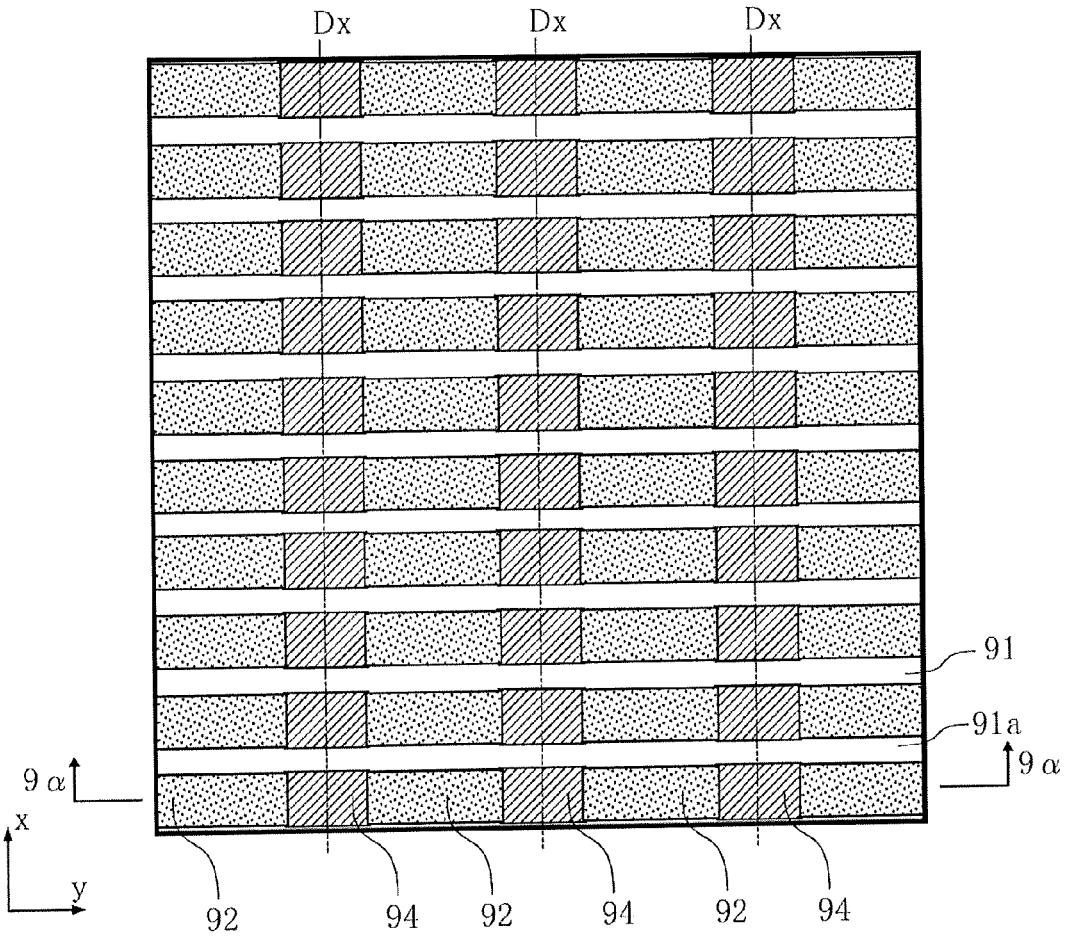
FIG. 45A Related Art
FIG. 45A is a plan view illustrating a step of a chip resistor manufacturing method as related art of the present invention.
Figure 45B:
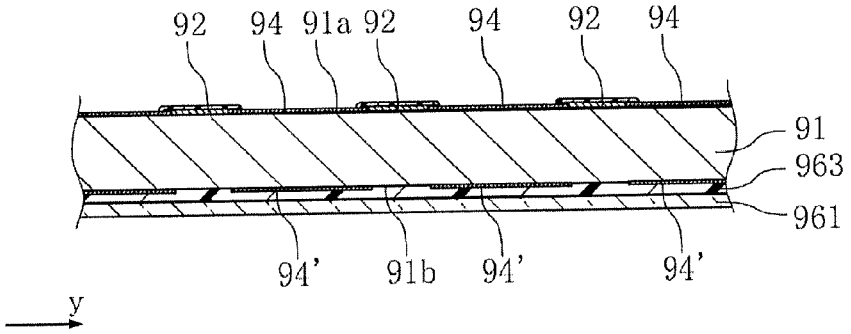
FIG. 45B Related Art
FIG. 45B is a sectional view taken along lines 9δ-9δ in FIG. 45A.

Then, as illustrated in FIG. 42, the material substrate 7 and the masking layer 63 are collectively diced to form grooves 71 in the material substrate 7. Then, as illustrated in FIG. 43, atoms of a conductive material are sputtered onto the obverse surface 7*a* of the material substrate 7. By this process, a conductor layer 3 is formed on the side surfaces 711 and bottom surface 712 of each groove 71 and also on the masking layer 63. Then, as illustrated in FIG. 44, a separation groove 72 is formed in each groove 71, and the substrate sections 73 are separated from each other along the lines Dx. Then, by performing the same process steps as those of the method of manufacturing the chip resistor A2 of the second embodiment, the chip resistors A3 as illustrated in FIG. 40 are completed.

In this embodiment again, the conductor layer 3 is formed on the side surfaces 711 of each groove 71. Similarly to the foregoing embodiments, this ensures the production of a chip resistor A3 having a high accuracy.

The technical scope of the present invention is not limited to the foregoing embodiments. The specific structure of the chip resistor and the manufacturing method according to the present invention may be varied in design in various ways.

The invention claimed is:

1. A method of manufacturing a chip resistor, the method comprising the steps of:

forming a surface electrode layer on an obverse surface of a material substrate;

forming a resistor layer on the obverse surface of the material substrate;

defining a plurality of substrate sections in the material substrate by forming, in the obverse surface of the material substrate, a plurality of first grooves each being elongated in a first direction and having a bottom surface, a part of the surface electrode layer being removed while each of the first grooves is being formed;

forming a conductor layer in each of the first grooves;

cutting the bottom surface of each of the first grooves with a dicing blade; and cutting the substrate sections in a second direction different from the first direction, wherein each of the first grooves has a first side surface and a second side surface that are spaced apart from each other in the second direction, in each of the first grooves, the conductor layer includes a first layer portion and a second layer portion that are disposed on the first side surface and the second side surface, respectively, the conductor layer further includes a bottom layer portion formed on the bottom surface, and the first layer portion and the second layer portion are spaced apart from each other via a vacant space in the second direction, and in each of the first grooves, the dicing blade cuts the bottom layer portion.

2. The method according to claim 1, wherein the dicing blade is smaller in width than said each of the first grooves.

3. The method according to claim 1, wherein the resistor layer comprises a plurality of resistor rows spaced from each other in the second direction, each of the resistor rows comprising a plurality of resistor strips arranged in the first direction, each of the resistor strips being elongated in the second direction, wherein in the step of defining a plurality of substrate sections, each of the first grooves is formed between adjacent two of the resistor rows.

4. The method according to claim 3, wherein the surface electrode layer comprises a plurality of surface electrode rows spaced from each other in the second direction, each of the surface electrode rows comprising a plurality of surface electrode portions arranged in the first direction, and wherein in the step of forming a resistor layer, each of the resistor strips is formed in a manner overlapping two of the surface electrode portions that are adjacent to each other in the second direction.

5. The method according to claim 3, wherein the conductor layer comprises a plurality of conductive portions each of which is electrically connected to one of the resistor strips.

6. The method according to claim 1, wherein the step of forming a conductor layer comprises printing a conductive material.

7. The method according to claim 1, wherein the step of forming a conductor layer comprising sputtering of a conductive material.

8. The method according to claim 7, further comprising the step of forming, before forming the conductor layer, a masking layer that covers the resistor layer and is provided with openings for exposing the first grooves.

9. The method according to claim 1, wherein each of the first layer portion and the second layer portion has a thickness measured in the second direction, and said thickness is smaller than a distance between the first layer portion and the second layer portion in the second direction.

10. The method according to claim 9, wherein the conductor layer includes the bottom layer portion disposed on the bottom surface of each of the first grooves, and the bottom layer portion has a thickness smaller than a depth of said each of the first grooves.

11. The method according to claim 10, wherein in each of the first grooves, the bottom layer portion connects the first layer portion and the second layer portion to each other.

12. The method according to claim 10, further comprising the step of forming, in the bottom surface of each of the first grooves, a second groove smaller in width than said each of the first grooves.

13. The method according to claim 12, wherein the width of the second groove is smaller than the distance between the first layer portion and the second layer portion in the second direction.

14. The method according to claim 12, wherein the forming of the second groove is performed using a dicing blade.

15. The method according to claim 14, wherein in the step of forming the second groove, a part of the bottom layer portion is removed by the dicing blade.

16. The method according to claim 15, wherein the bottom layer portion includes a central part, a first marginal part and a second marginal part, the central part being flanked by the first marginal part and the second marginal part in the second direction, and only the central part among the three parts is removed by the dicing blade.

17. The method according to claim 16, wherein after the second groove is formed, the first marginal part protrudes from the first layer portion in the second direction, and the second marginal part protrudes from the second layer portion in the second direction.

18. The method according to claim 17, wherein the first layer portion is in direct contact with the first side surface, and the second layer portion is in direct contact with the second side surface.

19. The method according to claim 1, further comprising the step of forming, before forming the conductor layer, a masking layer that covers the resistor layer and is provided with openings for exposing the first grooves, wherein in each of the first grooves, at least a part of each of the first side surface and the second side surface is covered with the masking layer.

* * * * *